US010576521B2

(12) United States Patent
Tokunaga et al.

(10) Patent No.: US 10,576,521 B2
(45) Date of Patent: Mar. 3, 2020

(54) ROLL FEEDER AND COILDED MATERIAL CONVEYANCE METHOD

(71) Applicant: KOMATSU INDUSTRIES CORPORATION, Kanazawa-shi, Ishikawa (JP)

(72) Inventors: Hidekazu Tokunaga, Komatsu (JP); Makoto Ishihara, Komatsu (JP)

(73) Assignee: KOMATSU INDUSTRIES CORPORATION, Ishikawa (JP)

( * ) Notice: Subject to any disclaimer, the term of this patent is extended or adjusted under 35 U.S.C. 154(b) by 21 days.

(21) Appl. No.: 15/780,251

(22) PCT Filed: Feb. 1, 2017

(86) PCT No.: PCT/JP2017/003652
§ 371 (c)(1),
(2) Date: May 31, 2018

(87) PCT Pub. No.: WO2017/150061
PCT Pub. Date: Sep. 8, 2017

(65) Prior Publication Data

US 2018/0369891 A1 Dec. 27, 2018

(30) Foreign Application Priority Data

Mar. 1, 2016 (JP) ..... 2016-039251

(51) Int. Cl.
*B21D 1/05* (2006.01)
*B65H 23/038* (2006.01)
(Continued)

(52) U.S. Cl.
CPC ..... *B21D 1/05* (2013.01); *B21B 37/68* (2013.01); *B21D 43/02* (2013.01); *B21D 43/09* (2013.01);
(Continued)

(58) Field of Classification Search
CPC ..... B65H 23/038; B65H 2701/173; B21B 37/68; B21B 39/006; B21B 39/14;
(Continued)

(56) References Cited

U.S. PATENT DOCUMENTS 3,186,273 A * 6/1965 Tomberg ..... B65H 23/1882 83/74
3,966,105 A * 6/1976 Curran ..... B65H 23/038 226/21
(Continued)

FOREIGN PATENT DOCUMENTS

CN 1498704 A 5/2004
CN 1698988 A 11/2005
(Continued)

OTHER PUBLICATIONS

The International Search Report for the corresponding international application No. PCT/JP2017/003652, dated Apr. 4, 2017.
(Continued)

*Primary Examiner* — William A. Rivera
(74) *Attorney, Agent, or Firm* — Global IP Counselors, LLP

(57) ABSTRACT

A roll feeder is usable to intermittently feed a coiled material. The roll feeder includes a paired first roll and second roll, a meandering detector, a pressing component, and a controller. The paired first roll and second roll are disposed so as to clamp the coiled material. The paired first roll and second roll are configured to feed the coiled material in a conveyance direction. The meandering detector is configured to detect meandering of the coiled material from a specific conveyance position in a width direction perpendicular to the conveyance direction of the coiled material. The pressing component is configured to press the first roll against the coiled material being conveyed. The controller is configured to control the pressing component so as to correct the meandering based on detection by the meandering detector.

11 Claims, 13 Drawing Sheets

(51) Int. Cl.

| | |
|---|---|
| ***B21D 43/02*** | (2006.01) |
| ***B21D 43/09*** | (2006.01) |
| ***B21B 37/68*** | (2006.01) |
| ***B21B 39/00*** | (2006.01) |
| ***B21B 39/14*** | (2006.01) |

(52) U.S. Cl.
CPC ..... *B65H 23/038* (2013.01); *B21B 39/006* (2013.01); *B21B 39/14* (2013.01); *B21B 2265/02* (2013.01); *B65H 2701/173* (2013.01)

(58) Field of Classification Search
CPC ..... B21B 2265/02; B21D 1/05; B21D 43/02; B21D 43/09
See application file for complete search history.

(56) References Cited

U.S. PATENT DOCUMENTS 4,209,708 A * 6/1980 Galimberti nee Sestini ..... B65H 23/1886 250/548
4,485,982 A * 12/1984 St. John ..... B65H 23/00 101/484
4,835,547 A * 5/1989 Okushi ..... B41J 15/16 226/15
10,053,322 B2 * 8/2018 Sato ..... B41J 15/04
2004/0079780 A1 * 4/2004 Kato ..... B21C 47/18 226/24

FOREIGN PATENT DOCUMENTS

| | | | |
|---|---|---|---|
| JP | 56-28151 | A | 3/1981 |
| JP | 62-197225 | A | 8/1987 |
| JP | 11-43248 | A | 2/1999 |
| JP | 2009-279686 | A | 12/2009 |

OTHER PUBLICATIONS

The Office Action for the corresponding Chinese application No. 201780004489.1, dated Feb. 2, 2019.
The Office Action for the corresponding Japanese application No. 2016-039251, dated Oct. 8, 2019.

* cited by examiner

ROLL FEEDER AND COILDED MATERIAL CONVEYANCE METHOD

CROSS-REFERENCE TO RELATED APPLICATIONS

This application is a U.S. National stage application of International Application No. PCT/JP2017/003652, filed on Feb. 1, 2017. This U.S. National stage application claims priority under 35 U.S.C. § 119(a) to Japanese Patent Application No. 2016-039251, filed in Japan on Mar. 1, 2016, the entire contents of which are hereby incorporated herein by reference.

BACKGROUND

Field of the Invention

The present invention relates to a roll feeder and a coiled material conveyance method.

Description of the Related Art

A configuration comprising an uncoiler, a leveler, a roll feeder, a tension roll device, a pressing machine, etc., has been disclosed as a system for producing a forming product by pressing a coiled material (see, for example, JP-A S62-197225).

In the conveyance of a coiled material in a system such as this, the coiled material sometimes meanders because the thickness of the coiled material is not uniform. With the system disclosed in JP-A S62-197225, a mechanism for correcting meandering is provided to a tension roll device.

With the mechanism for correcting meandering discussed in JP-A S62-197225, a plurality of meandering correction bolts are threaded into a supporting plate that supports the tension roll, and meandering is corrected by adjusting these meandering correction bolts.

SUMMARY

However, even if meandering of the coiled material is corrected by adjusting the meandering correction bolts as described above, meandering may occur again in some cases, so the operator constantly has to check the conveyance state of the coiled material.

Also, every time meandering is confirmed the worker has to stop the system and go inside the device to adjust the meandering correcting bolts, which results in low work efficiency.

In light of the above problems encountered in the past, it is an object of the present invention to provide a roll feeder and a coiled material conveyance method with which it is a simple matter to correct meandering.

The roll feeder pertaining to the first aspect is a roll feeder for intermittently feeding a coiled material, comprising a paired first roll and second roll, a pressing component, a meandering detector, and a controller. The paired first roll and second roll are disposed so as to clamp the coiled material and feed the coiled material in the conveyance direction. The meandering detector detects meandering from a specific conveyance position of the coiled material in the width direction perpendicular to the conveyance direction of the coiled material. The pressing component presses the first roll against the coiled material being conveyed. The controller controls the pressing component so as to correct the meandering on the basis of detection by the meandering detector.

This makes it possible to correct meandering of a coiled material by controlling the pressing component on the basis of detection by the meandering detector. Therefore, it is unnecessary for the operator to constantly monitor the process, and the operator does not have to go into the device, so it is a simple matter to correct meandering.

The roll feeder pertaining to the second aspect is the roll feeder pertaining to the first aspect, wherein the pressing component has a first pressure applicator and a second pressure applicator. The first pressure applicator is linked to a first end side of the first roll and applies pressure to the first end so as to press the coiled material being conveyed. The second pressure applicator is linked to a second end side of the first roll and applies pressure to the second end so as to press the coiled material being conveyed. The controller corrects the meandering by controlling the first pressure applicator and the second pressure applicator to adjust the pressing force of the first end and the second end against the coiled material.

Thus adjusting the pressure applied to the first end and the second end of the first roll makes it possible to correct meandering of the coiled material when it has deviated toward the first end side or the second end side.

The roll feeder pertaining to the third aspect is the roll feeder pertaining to the second aspect, wherein the meandering detector detects a meandering amount in which the coiled material has deviated from the specific conveyance position toward the first end side or the second end side. The controller controls the pressing component so that when it is detected by the meandering detector that the coiled material is moving by more than a specific threshold from the specific conveyance position toward the first end side, the pressure applied to the first end is raised and the pressure applied to the second end is lowered, and when it is detected by the meandering detector that the coiled material is moving by more than the specific threshold from the conveyance position toward the second end side, the pressure applied to the second end is raised, and the pressure applied to the first end is lowered.

Consequently, when the coiled material meanders due to a positional deviation exceeding a specific threshold value from a specific conveyance position toward the first end side, or exceeding a specific threshold value from the specific conveyance position to the second end side, the meandering can be corrected. The specific threshold can be set within a range in which the positional deviation of the coiled material from the specific conveyance position can be permitted.

The roll feeder pertaining to the fourth aspect is the roll feeder pertaining to the third aspect, wherein the controller reduces the pressure from a second pressure setting value predetermined for the second end by an adjustment amount that increases the pressure from a first pressure setting value predetermined for the first end when the pressure applied to the first end is raised. The controller reduces the pressure from the first pressure setting value by an adjustment amount that increases the pressure from the second pressure setting value when the pressure applied to the second end is raised.

Thus, when the pressing force on the first end side of the coiled material is increased by a specific amount, the pressing force on the second end side is decreased by the same amount. This prevents rolling of the coiled material when the pressing force on the first roll as a whole has been raised too much.

The roll feeder pertaining to the fifth aspect is the roll feeder pertaining to the fourth aspect, wherein the controller sets the adjustment amount on the basis of how much the meandering amount of the coiled material exceeds the specific threshold.

Consequently, control can be performed so as to increase the adjustment amount as the amount by which meandering exceeds a specific threshold increases, for example.

The roll feeder pertaining to the sixth aspect is the roll feeder pertaining to the fourth aspect, wherein the controller sets the adjustment amount during feed of the coiled material the n+1-th time (n is a natural number of at least 1) on the basis of the amount of change in the meandering amount during feed of the coiled material the n-th time from the meandering amount during feed of the coiled material the n−1-th time.

Consequently, the adjustment amount of the pressure during feed of the coiled material the n+1-th time can be changed on the basis of the amount of change in the meandering amount during feed of the coiled material the n−1-th time and the meandering amount during feed of the coiled material the n-th time. That is, the adjustment amount of the pressure during the next feed of the coiled material can be changed on the basis of the amount of change between the meandering amount during feed of the coiled material the previous time and the meandering amount during feed of the coiled material this time.

The roll feeder pertaining to the seventh aspect is the roll feeder pertaining to the sixth aspect, wherein, when the meandering amount during feed of the coiled material the n−1-th time is compared to the meandering amount during feed of the coiled material the n-th time, and it is determined that the meandering amount of the coiled material is increasing, the controller increases the adjustment amount during feed of the coiled material the n+1-th time more than the adjustment amount during feed of the coiled material the n-th time.

Thus, when the meandering amount during feed of the coiled material the n-th time is increasing as compared to the meandering amount during feed of the coiled material the n−1-th time, it can be determined that meandering is progressing, so the adjustment amount during feed of the coiled material the next time is set to be larger than the adjustment amount during feed of the coiled material the n-th time. For example, when the pressure applied to the first end of the first roll during feed of the coiled material this time is increased by a specific amount, and the pressure applied to the second end is decreased by a specific amount, the next time, the pressing component is controlled so that the pressure applied to the first end will be further increased and the pressure applied to the second end will be further decreased.

The progress of meandering can be thereby be curtailed.

The roll feeder pertaining to the eighth aspect is the roll feeder pertaining to the seventh aspect, wherein the controller increases the adjustment amount during feed of the coiled material the n+1-th time on the basis of how much the meandering amount of the coiled material has exceeded the specific threshold and the amount of change in the meandering amount the n-th time.

This allows the amount by which the adjustment amount is increased to be adjusted.

The roll feeder pertaining to the ninth aspect is the roll feeder pertaining to the seventh aspect, wherein, when the meandering amount during feed of the coiled material the n−1-th time is compared to the meandering amount during feed of the coiled material the n-th time, and it is determined that the meandering amount of the coiled material has stopped increasing or the meandering amount is decreasing, the controller sets the adjustment amount during feed of the coiled material the n+1-th time on the basis of how much the meandering amount of the coiled material has exceeded the specific threshold and the amount of change in the meandering amount the n-th time.

Consequently, the adjustment amount can be determined so that the meandering correction will be further strengthened at a stage where the threshold is still exceeded by a large amount even after correction, and conversely, if the amount of change in the meandering amount becomes too large, correction will be weakened so that the material will not meander to the opposite side. Therefore, it is possible to eliminate meandering more quickly and to prevent meandering to the opposite side due to over-correction.

The roll feeder pertaining to the tenth aspect is the roll feeder pertaining to any of the first to ninth aspects, wherein meandering detector has laser sensors disposed on both sides in the width direction.

This makes it possible to sense the amount of positional deviation at both ends in the width direction of the coiled material, and to control the pressing component on the basis of this sensed value.

The coiled material conveyance method pertaining to the eleventh aspect is a coiled material conveyance method for intermittently feeding a coiled material, said method comprising a feed step, a stoppage step, a meandering detection, and a pressure adjustment step. The feed step involves feeding the coiled material a specific length in the conveyance direction in between a pair of rolls. The stoppage step involves stopping the feed of the coiled material after the feed step. The meandering detection step involves detecting movement of the coiled material from a specific conveyance position in the width direction perpendicular to the conveyance direction of the coiled material during the stoppage step. The pressure adjustment step involves adjusting the pressing force of a roll pressing on the coiled material being conveyed, so as to correct the meandering, on the basis of detection in the meandering detection step. The coiled material is conveyed by repeating the feed step, the stoppage step, the meandering detection step, and the pressure adjustment step.

In this way, meandering of the coiled material can be corrected by adjusting the pressing force on the coiled material in the pressure adjustment step on the basis of the detection in the meandering detecting step. Therefore, the operator does not have to constantly monitor the process, and does not have to go into the device, so it is a simple matter to correct meandering.

The present invention provides a roll feeder and a coiled material conveyance method with which meandering can be easily corrected.

DETAILED DESCRIPTION OF EMBODIMENT(S)

A coil line system comprising the roll feeder pertaining to an embodiment of the present invention will now be described through reference to the drawings.

1. Configuration 1-1. Overview of Coil Line System 1

Figure 1:
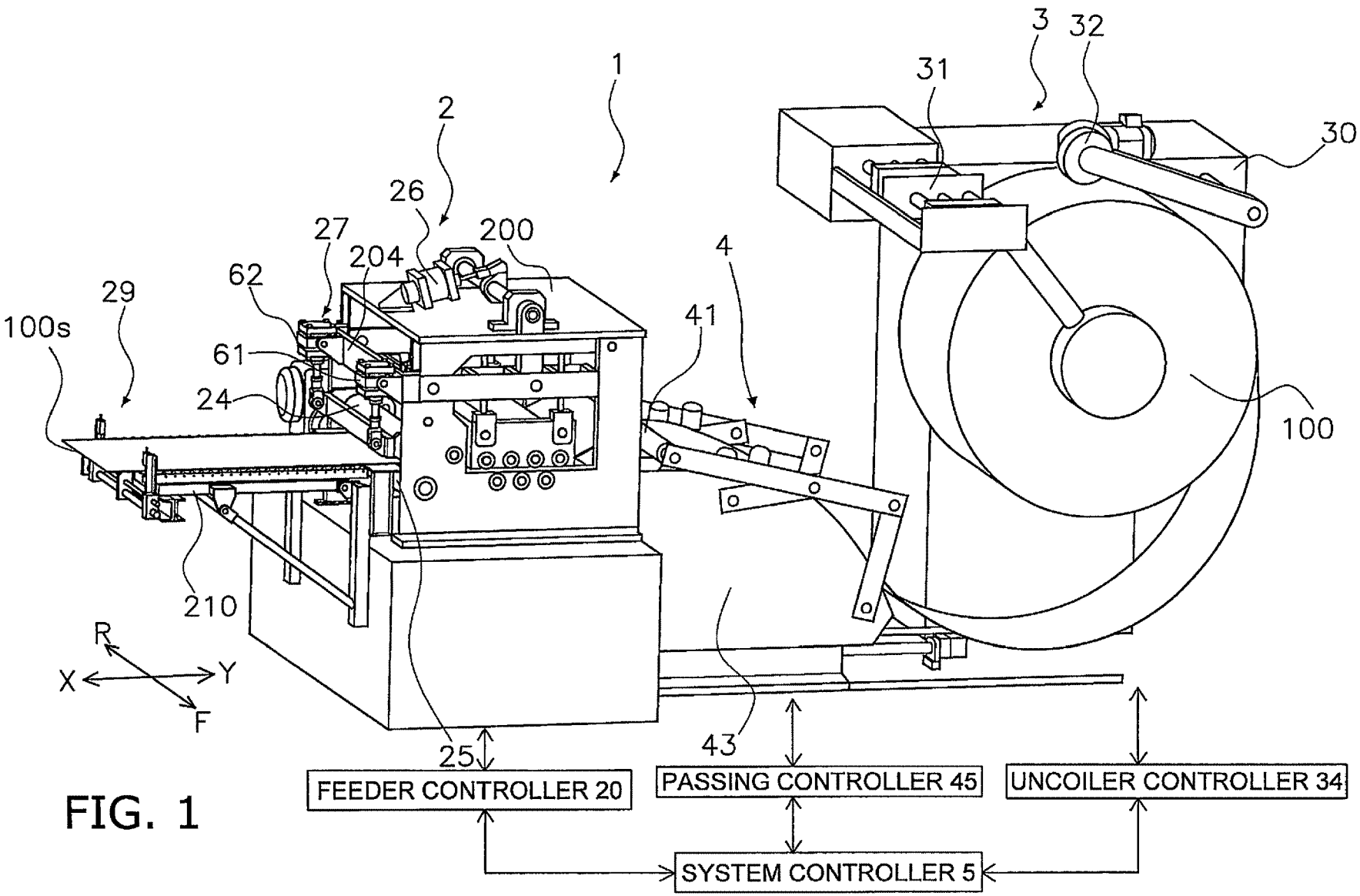
FIG. 1 is an oblique view of the configuration of a coil line system in an embodiment of the present invention.
Figure 2:
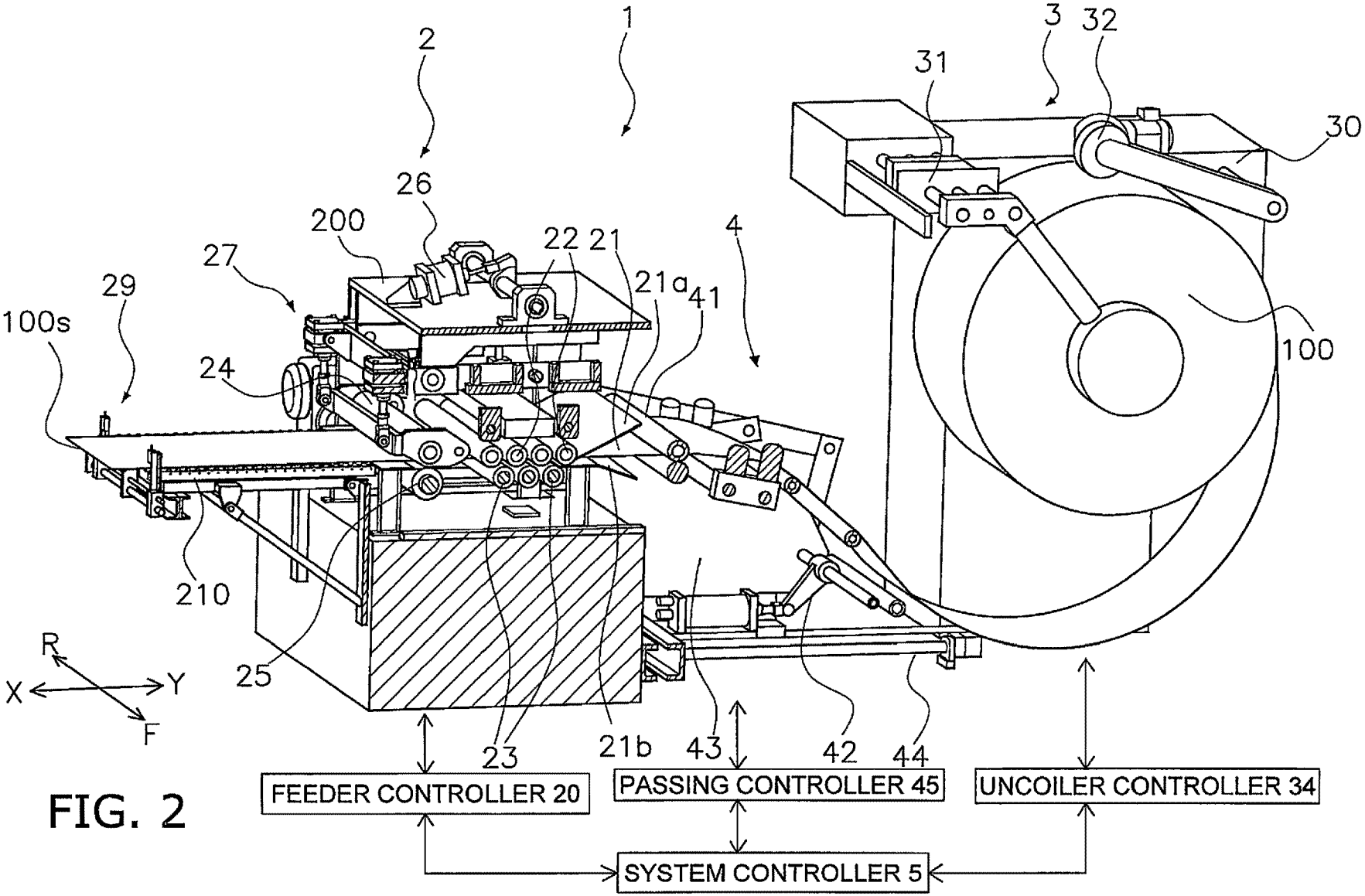
FIG. 2 is a partial cross section of the coil line system in FIG. 1.

FIG. 1 is a simplified diagram of the configuration of a coil line system 1 in this embodiment. FIG. 2 is a partial cross section showing the internal configuration of the coil line system 1.

The coil line system 1 in this embodiment is a system for sending a coiled material 100 to a pressing machine (not shown).

As shown in FIG. 1, the coil line system 1 comprises a leveler feeder 2, an uncoiler 3, a coiled material passing device 4, and a system controller 5.

The leveler feeder 2 corrects winding curl and the like in the coiled material 100 supplied from a receiver port 21 (see FIG. 2). The coiled material 100 is supplied from the uncoiler 3 to the receiver port 21 of the leveler feeder 2.

The uncoiler 3 unwinds the coiled material 100 (a steel sheet, etc., that is wound in a coil) while feeding it to the leveler feeder 2.

The coiled material passing device 4 is provided more or less between the leveler feeder 2 and the uncoiler 3. The coiled material passing device 4 automatically guides the starting end 100*s* of the coiled material 100 played out from the uncoiler 3 to the receiver port 21 of the leveler feeder 2.

The downstream side of the coiled material 100 in the transport direction is shown as X, and the upstream side is shown as Y. Also, the left side facing the downstream direction X side is indicated by the arrow F as the front side, and the right side facing the downstream direction X side is indicated by the arrow R as the rear side.

The system controller 5 transmits commands to the leveler feeder 2, the uncoiler 3, and the coiled material passing device 4 on the basis of worker input from a control panel (not shown).

1-2. Uncoiler 3

The uncoiler 3 unwinds and plays out the required amount of the coiled material 100, which is wound in a coil shape. As shown in FIG. 1, the uncoiler 3 has the coil support 30, the coil guide 31, a hold-down roll 32, a drive mechanism 33 (see FIG. 9), and an uncoiler controller 34.

The coil support 30 rotatably supports the coiled material 100 that is wound in a coil. The coil guide 31 guides the playout of the coiled material 100. The hold-down roll 32 holds the coiled material 100 down.

Figure 9:
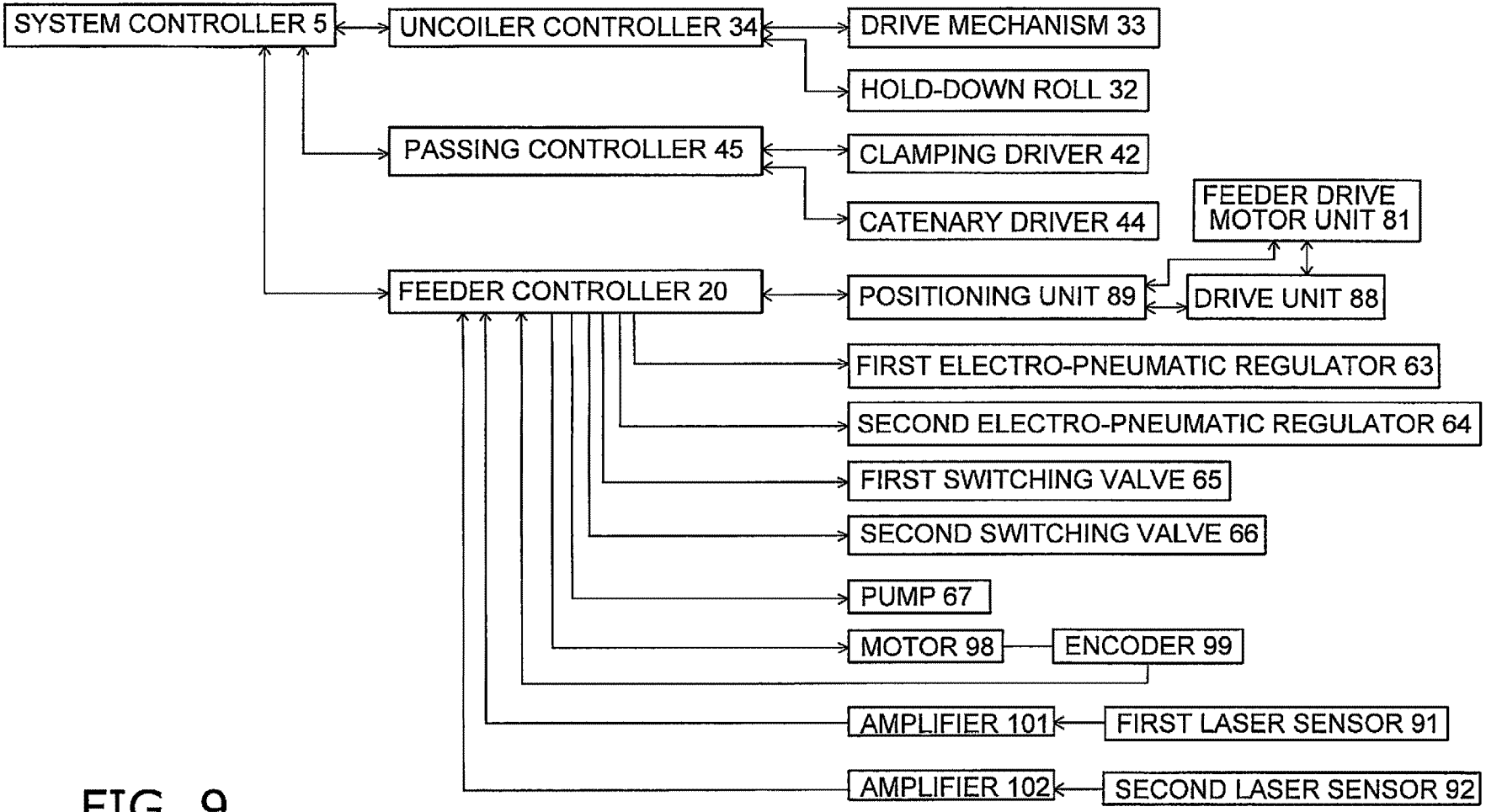
FIG. 9 is a block diagram of the control configuration of the coil line system in FIG. 1.

The drive mechanism 33 shown in FIG. 9 drives the coiled material 100 supported by the coil support 30 in forward rotation (the direction in which the coiled material 100 is played out) or in reverse rotation.

The uncoiler controller 34 controls the drive mechanism 33, the hold-down roll 32, and the like on the basis of commands from the system controller 5.

1-3. Coiled Material Passing Device 4

The coiled material passing device 4 passes the starting end 100*s* of the coiled material 100 played out from the uncoiler 3 into the receiver port 21 of the leveler feeder 2 when the coiled material 100 is placed in the uncoiler 3 (see FIG. 2).

As shown in FIG. 2, the coiled material passing device 4 has a clamper 41, a clamping driver 42, a catenary component 43, a catenary driver 44, and a passing controller 45. The clamper 41 has a threading roll that can be moved in the up and down direction by a link mechanism and a lower pinch roll, and clamps the starting end 100*s* of the coiled material 100 between the threading roll and the lower pinch roll. The clamping driver 42 moves the threading roll up and down to clamp the coiled material 100. The catenary component 43 supports the clamper 41 and is able to move between the uncoiler 3 and the leveler feeder 2. The catenary driver 44 has a motor, a ball screw connected to the motor, etc. The ball screw is threaded with a nut member attached to the catenary component 43, and when the ball screw is rotated by the motor, the catenary component 43 is moved between the uncoiler 3 and the leveler feeder 2. The passing controller 45 drives the clamping driver 42 and the catenary driver 44 on the basis of a command from the system controller 5.

1-4. Leveler Feeder 2

Figure 3:
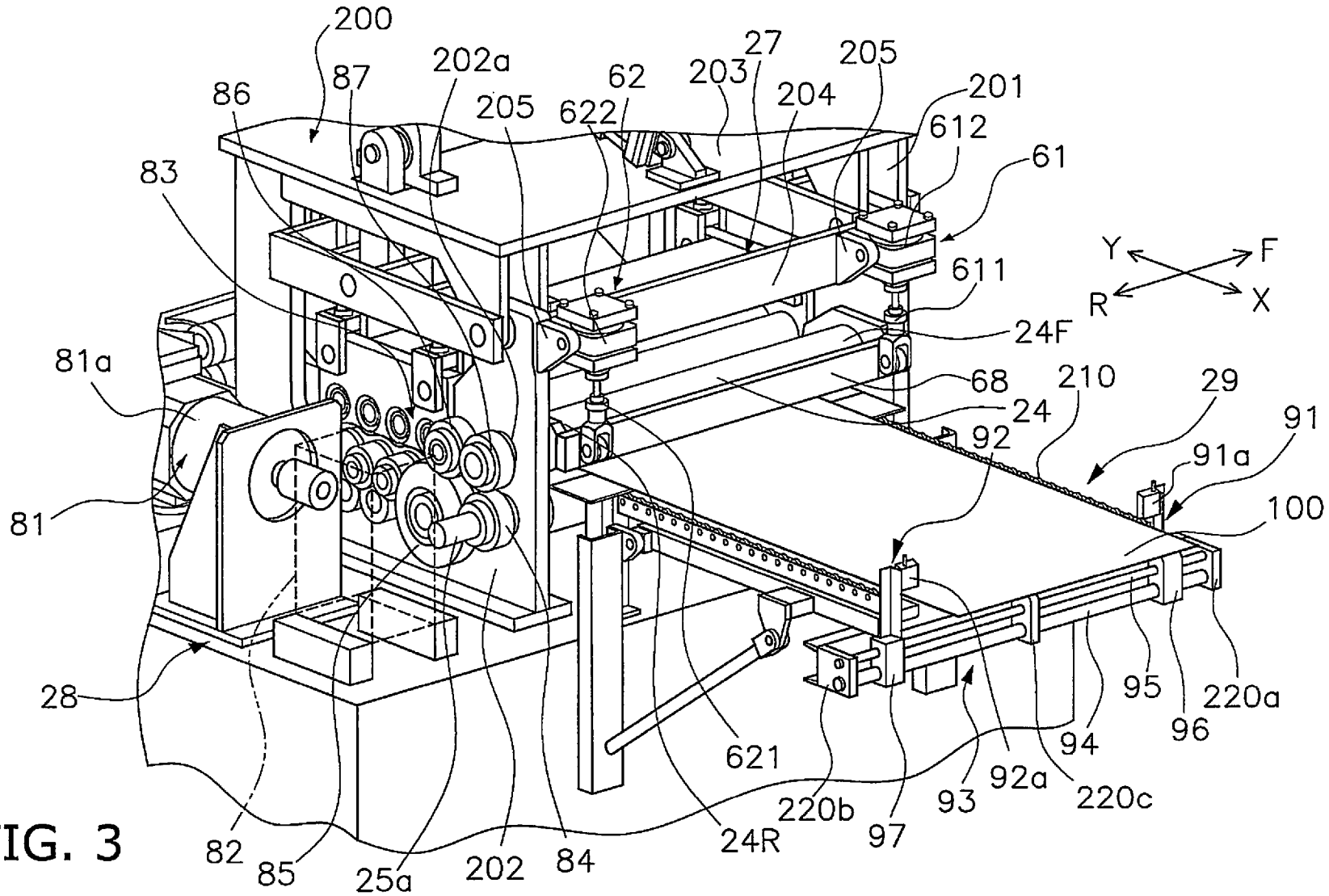
FIG. 3 is an oblique view of the leveler feeder in FIG. 1 as seen from the rear.
Figure 4:
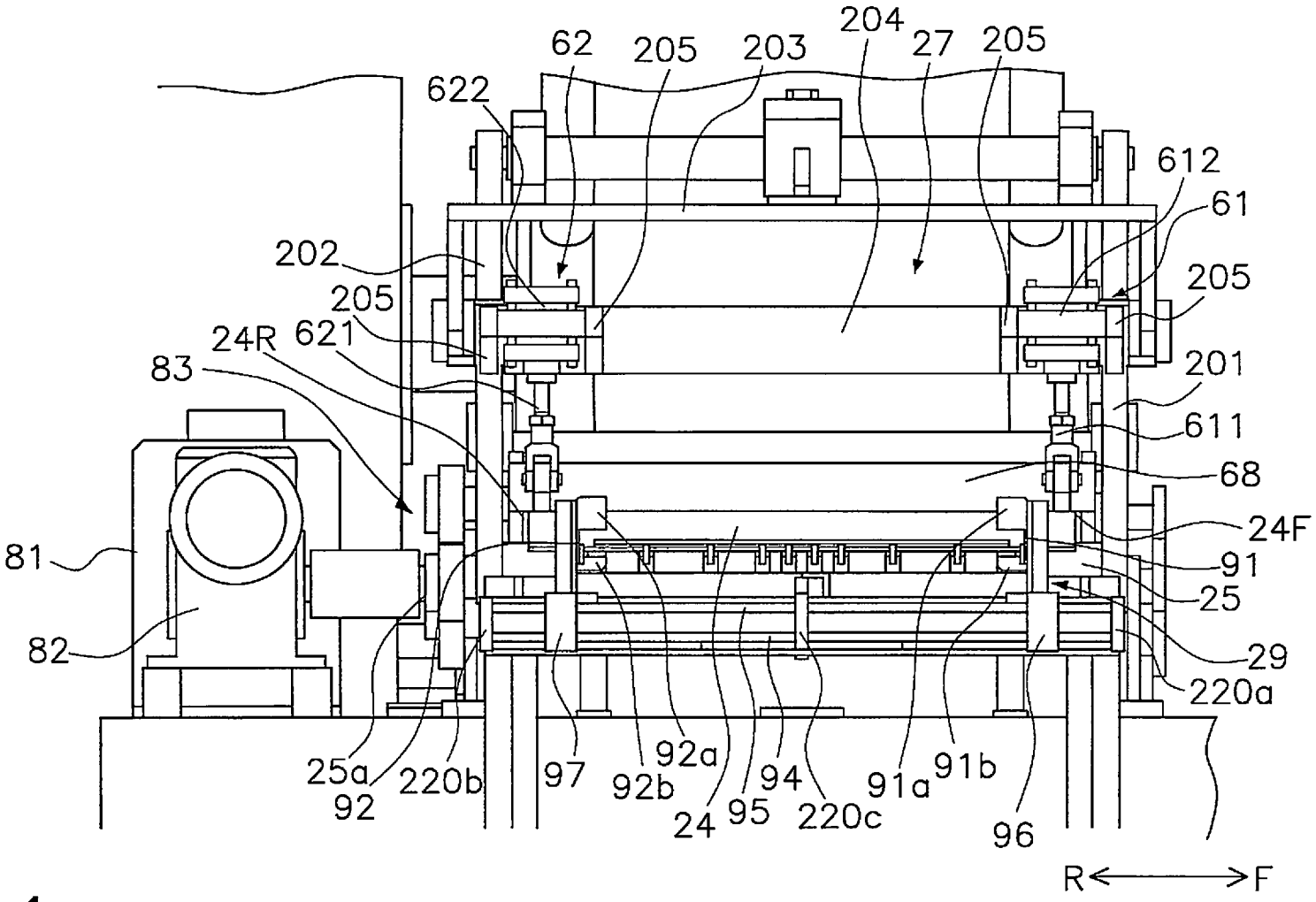
FIG. 4 is a view of the leveler feeder in FIG. 3 as seen from the downstream direction side.

FIG. 3 is a view of the leveler feeder 2 in FIG. 1 as seen from the rear side. FIG. 4 is a view of the leveler feeder 2 in FIG. 1 as seen from the downstream direction side.

As shown in FIGS. 2 to 4, the leveler feeder 2 has a housing 200, the receiver port 21, a plurality of upper work rolls 22, a plurality of lower work rolls 23, an upper feed roll 24, a lower feed roll 25, a release drive cylinder 26, a pressing component 27, a leveler feeder driver 28, a meandering detector 29, a table 210, and a feeder controller 20.

1-4-1. Receiver Port 21

As shown in FIG. 2, the receiver port 21 is formed on the uncoiler 3 side of the leveler feeder 2 of the housing 200, and the coiled material 100 played out from the uncoiler 3 is carried in. The receiver port 21 is formed by an upper guide plate 21*a* and a lower guide plate 21*b* that are supported by the housing 200 and are disposed one above the other. The upper guide plate 21*a* and the lower guide plate 21*b* are formed such that the uncoiler 3 side is inclined so as to increase the vertical spacing between the upper guide plate 21*a* and the lower guide plate 21*b* moving toward the uncoiler 3.

1-4-2. Upper Work Rolls 22 and Lower Work Rolls 23

In FIG. 2, four upper work rolls 22 are disposed, and three lower work rolls 23 are disposed on the lower side of the upper work rolls 22. The upper work rolls 22 and the lower work rolls 23 are disposed on the downstream direction side X side of the upper guide plate 21*a* and the lower guide plate 21*b* and are rotatably supported by the housing 200. The upper work rolls 22 and the lower work rolls 23 are disposed alternating along the conveyance direction, and straighten out the winding curl of the coiled material.

The release drive cylinder 26 is linked to the upper work rolls 22, and separates the upper work rolls 22 from the lower work rolls 23 when a pressing operation is performed at the pressing machine.

1-4-3. Upper Feed Roll 24 and Lower Feed Roll 25

The upper feed roll 24 and the lower feed roll 25 are rotatably supported by the housing 200.

As will be described in detail below, the coiled material 100 is fed toward the pressing machine by intermittently rotating the upper feed roll 24 and the lower feed roll 25.

1-4-4. Pressing Component 27

The pressing component 27 shown in FIGS. 2 to 4 presses on the coiled material 100 with the upper feed roll 24 by applying pressure on the upper feed roll 24 toward the lower feed roll 25.

Figure 5:
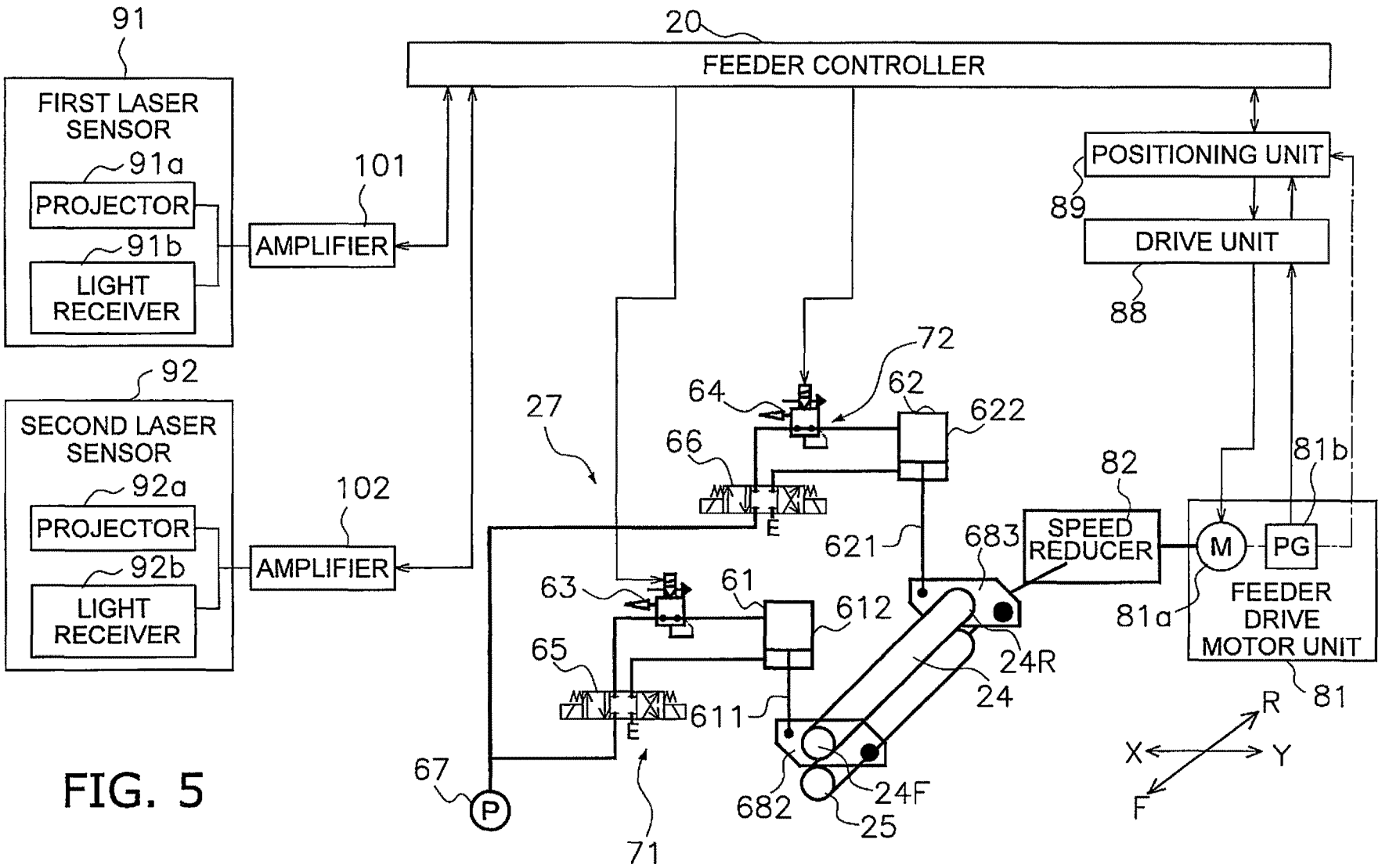
FIG. 5 is a block diagram of the control configuration of the leveler feeder in FIG. 3.

FIG. 5 is a block diagram of the control configuration of the leveler feeder 2 in this embodiment. As shown in FIG. 5, the pressing component 27 has a first air cylinder 61, a second air cylinder 62, a first pneumatic circuit 71, and a second pneumatic circuit 72.

The first air cylinder 61 and the second air cylinder 62 apply a downward pressure to the upper feed roll 24. The first pneumatic circuit 71 is a circuit for applying air pressure to the first air cylinder 61. The second pneumatic circuit 72 is a circuit for applying air pressure to the second air cylinder 62.

First Air Cylinder 61 and Second Air Cylinder 62

As shown in FIGS. 3 and 4, the first air cylinder 61 applies a downward pressure to a first end 24F, which is the end on the front F side of the upper feed roll 24. The second air cylinder 62 applies a downward pressure to the second end 24R, which is the end on the rear R side of the upper feed roll 24.

As shown in FIGS. 3 to 5, the first air cylinder 61 is provided above the first end 24F such that a cylinder rod 611 follows along the up and down direction. As shown in FIGS. 3 to 5, the second air cylinder 62 is provided above the second end 24R such that a cylinder rod 621 follows along the up and down direction. The first air cylinder 61 and the second air cylinder 62 are disposed side by side in the front-rear direction (the arrow FR direction).

As shown in FIGS. 3 and 4, a cylinder tube 612 of the first air cylinder 61 and a cylinder tube 622 of the second air cylinder 62 are supported by the housing 200. The housing 200 has a first side face 201 disposed on the front direction F side, a second side face 202 disposed on the rear direction R side, and a top face 203 that connects the first side face 201 and the second side face 202. The housing 200 also has a plate-like support member 204 that connects the first side face 201 and the second side face 202 to the upper part on the downstream direction X side. The support member 204 is provided with four plate-like protruding members 205 that protrude to the downstream direction X side along the front-rear direction (the direction of the arrow FR). The cylinder tube 612 is disposed so as to be sandwiched between two the protruding members 205 provided closer to the front direction F side, and is rotatably supported by the two protruding members 205. The cylinder tube 622 is disposed so as to be sandwiched between the two protruding members 205 provided closer to the rear direction R side, and is rotatably supported by the two protruding members 205.

Linking Structure Between Cylinder Rods and Upper Feed Roll

The cylinder rod 611 of the first air cylinder 61 and the cylinder rod 621 of the second air cylinder 62 are rotatably connected to a linking member 68 that is linked to the upper feed roll 24.

Figure 6:
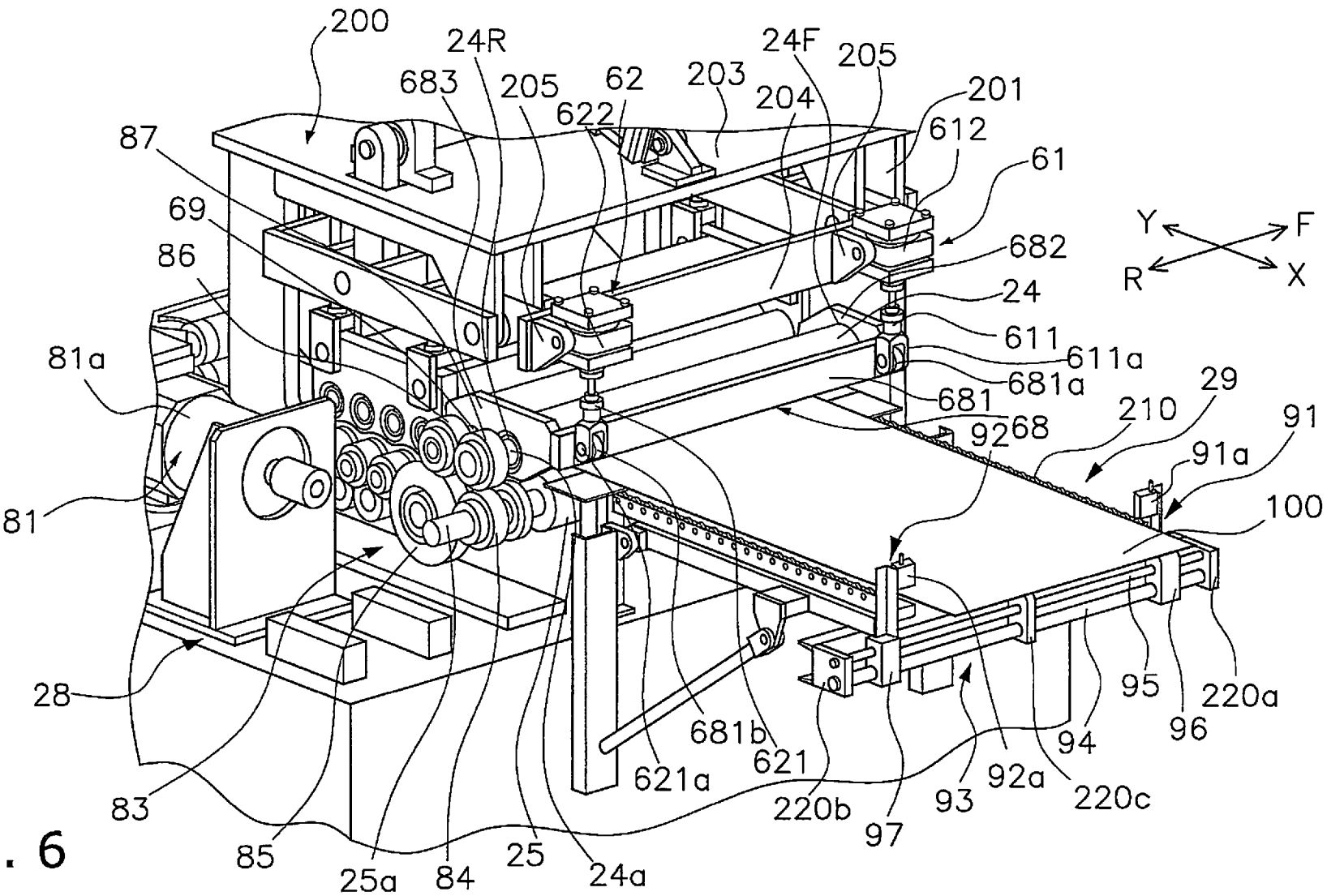
FIG. 6 is a diagram of the state when a side face on the rear side has been removed from the leveler feeder in FIG. 3.
Figure 7:
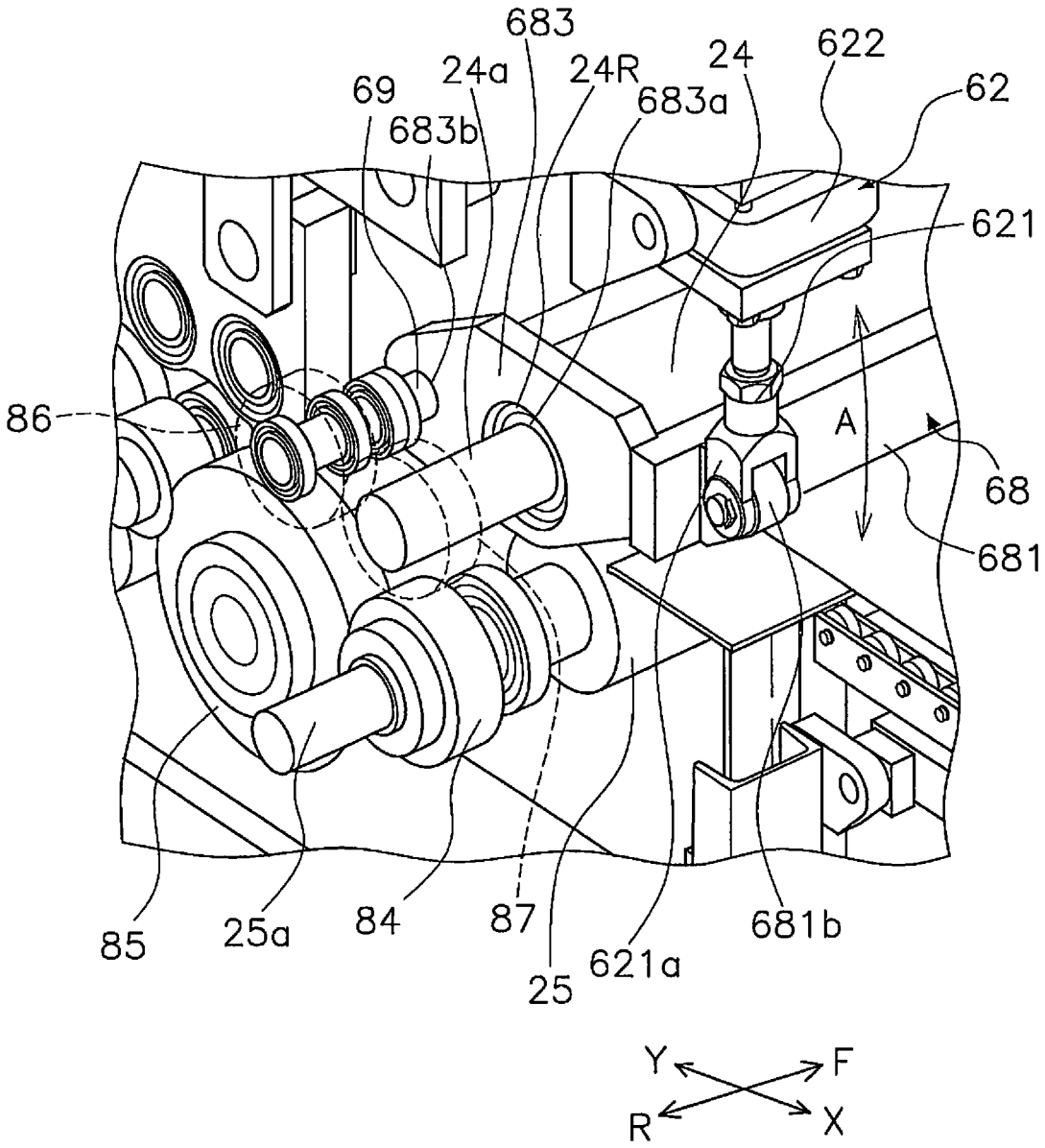
FIG. 7 is detail view of the leveler feeder on FIG. 6.

FIG. 6 shows the state when the second side face 202 of the housing 200 has been removed. FIG. 7 is a diagram of the area near the cylinder rod 621 of the second air cylinder 62 in FIG. 6. In FIG. 7, a third transmission gear 86 and a fourth transmission gear 87 (discussed below) are indicated by dotted lines in order to illustrate a third linking component 683.

As shown in FIG. 6, the linking member 68 has a first linking component 681 that is disposed along the front-rear direction (the direction of the arrow FR) and to which the cylinder rods 611 and 621 are connected, a second linking component 682 that is attached from the end of the first linking component 681 on the front direction F side toward the upstream side Y side, and a third linking component 683 that is attached from the end of the first linking component 681 on the rear direction R side toward the upstream direction Y side.

A first protrusion 681*a* that protrudes in the downstream direction X is provided near the end of the first connecting portion 681 on the front direction F side. The distal end 611*a* of the cylinder rod 611 of the first air cylinder 61 is formed in a bifurcated shape, and the first protrusion 681*a* is disposed so as to be sandwiched between the two forks. The distal end 611*a* is attached to the first protrusion 681*a* so as to be rotatable around the front-rear direction (the direction of the arrow FR).

Also, a second protrusion 681*b* that protrudes in the downstream direction X is provided near the end of the first linking component 681 in the rear direction R. The distal end 621*a* of the cylinder rod 621 of the second air cylinder 62 is formed in a bifurcated shape, and the second protrusion 681*b* is disposed so as to be sandwiched between the two forks. The distal end 621*a* is attached to the second protrusion 681*b* so as to be rotatable around the front-rear direction (the direction of the arrow FR).

With this configuration, the cylinder rods 611 and 621 are attached to the first linking component 681 of the linking member 68.

Since the second linking component 682 and the third linking component 683 have the same configuration, the description here will focus on the third linking component 683 on the rear direction R side.

As shown in FIG. 7, two through-holes 683*a* and 683*b* passing through in the front-rear direction (the arrow FR direction) are formed in the third linking component 683. The through-hole 683*a* and the through-hole 683*b* are disposed along the conveyance direction (the arrow XY direction), and the through-hole 683*a* is provided on the downstream direction X side of the through-hole 683*b*. The second end 24R on the rear direction R side of a shaft 24*a* of the upper feed roll 24 is rotatably inserted into the through-hole 683*a*. Similarly, two through-holes are formed in the second linking component 682, and the first end 24F (see FIG. 6) on the front direction F side of the shaft 24*a* is rotatably inserted into the through-hole on the downstream direction X side. Thus, the upper feed roll 24 is pivotally supported by the second linking component 682 and the third linking component 683 disposed in the front-rear direction (the arrow FR direction).

As shown in FIG. 7, a shaft 69 serving as the rotating shaft of the linking member 68 is inserted into the through-hole 683*b* of the linking component 683 and the through-hole on the upstream direction Y side of the second linking component 682.

With this configuration, when the cylinder rods 611 and 621 expand and contract, the linking member 68 to which the cylinder rods 611 and 621 are linked moves in the up and down direction (see the arrow A), scribing an arc around the shaft 69.

When a downward pressure is applied to the linking member 68 by the first air cylinder 61, a pressure is exerted on the end of the linking member 68 on the front direction F side, so a downward pressure is applied to the end 24F of the upper feed roll 24 on the front direction F side. Also, when a downward pressure is applied to the linking member 68 by the second air cylinder 62, pressure is exerted on the end of the linking member 68 on the rear direction R side, so a downward pressure is applied to the second end 24R on the rear direction R side of the upper feed roll 24.

The downward pressure applied to each of the first end 24F and the second end 24R of the upper feed roll 24 can be adjusted by adjusting the pressure applied to the linking member 68 with the first air cylinder 61 and the second air cylinder 62.

In performing a pressing operation, it is necessary to separate the upper feed roll 24 from the lower feed roll 25 so as not to apply tension to the coiled material 100. With the leveler feeder 2 in this embodiment, the cylinder rods 611 and 621 are contracted, causing the linking member 68 to rotate upward (see the arrow A in FIG. 7) around the shaft 69, and the upper feed roll 24 also to move upward.

As shown in FIG. 3, since the shaft 24*a* of the upper feed roll 24 passes through, the through-hole 202*a* formed in the second side face 202 is formed to a size that does not interfere with the side face 202 during movement of the upper feed roll 24 in the up and down direction.

First Pneumatic Circuit 71, Second Pneumatic Circuit 72

As shown in FIG. 5, the first pneumatic circuit 71 has a first electro-pneumatic regulator 63, a first switching valve 65, and a pump 67, all of which are connected by tubing. The second pneumatic circuit 72 includes a second electro-pneumatic regulator 64, a second switching valve 66, and a pump 67, all of which are connected by an air flow path such as tubing. The pump 67 is shared by the first pneumatic circuit 71 and the second pneumatic circuit 72.

The space inside the cylinder tube 612 is divided into upper and lower spaces by a piston that can move up and down in the cylinder tube 612, and the upper space and the lower space are each connected to a port of the first switching valve 65. The other port of the first switching valve 65 is connected to the pump 67, and the first switching valve 65 further has a port (see E) that is open to the atmosphere.

That is, the first switching valve 65 can switch between a state in which air is pumped from the pump 67 to the upper space of the cylinder tube 612 and air is discharged from the lower space, and a state in which air is pumped from the pump 67 to the lower space of the cylinder tube 612 and air is discharged from the upper space.

Also, the first electro-pneumatic regulator 63 is provided between the upper space of the cylinder tube 612 and the first switching valve 65. The pressure applied to the upper feed roll 24 by the extension of the cylinder rod 611 can be adjusted with the first electro-pneumatic regulator 63.

The space inside the cylinder tube 622 is divided into upper and lower spaces by a piston that can move up and down in the cylinder tube 622, and the upper space and the lower space are each connected to a port of the second switching valve 66. The other port of the second switching valve 66 is connected to the pump 67, and the second switching valve 66 further has a port (see E) that is open to the atmosphere.

That is, the second switching valve 66 can switch between a state in which air is pumped from the pump 67 to the upper space of the cylinder tube 622 and air is discharged from the lower space, and a state in which air is pumped from the pump 67 to the lower space of the cylinder tube 622 and air is discharged from the upper space.

The second electro-pneumatic regulator 64 is provided between the upper space of the cylinder tube 622 and the second switching valve 66. The pressure applied to the upper feed roll 24 by extending the cylinder rod 621 can be adjusted with second electro-pneumatic regulator 64.

1-4-5. Leveler Feeder Driver 28

The leveler feeder driver 28 rotationally drives the upper feed roll 24 and the lower feed roll 25. As shown in FIG. 3, the leveler feeder driver 28 has a feeder drive motor unit 81, a leveler feeder drive speed reducer 82 (see FIG. 4), and a drive transmission mechanism 83. In FIG. 3, the leveler feeder drive speed reducer 82 is indicated by a dotted line to illustrate the drive transmission mechanism 83.

As shown in FIG. 5, the feeder drive motor unit 81 includes a motor 81*a* and a pulse generator (PG) 81*b*. The PG 81*b* generates pulses according to the rotation of the motor 81*a*.

As shown in FIG. 3, the feeder drive motor unit 81 is disposed on the rear direction R side of the second side face 202. The rotation of the motor 81*a* of the feeder drive motor unit 81 is inputted to a shaft 25*a* of the lower feed roll 25 via the leveler feeder drive speed reducer 82.

The drive transmission mechanism 83 has a first transmission gear 84, a second transmission gear 85, a third transmission gear 86, and a fourth transmission gear 87. The first transmission gear 84 is disposed on the shaft 25*a* and rotates along with the shaft 25*a*. The second transmission gear 85 is rotatably disposed on the second side face 202 on the upstream direction Y side of the first transmission gear 84, and meshes with the first transmission gear 84. As shown in FIG. 6, the third transmission gear 86 is rotatably disposed on the shaft 69, which is the rotational axis of the above-mentioned linking member 68, on the upper side of the second transmission gear 85, and meshes with the second transmission gear 85. The fourth transmission gear 87 is disposed on the shaft 24*a* on the downstream side X side of the third transmission gear 86, and rotates along with the shaft 24*a*. The fourth transmission gear 87 meshes with the third transmission gear 86. Although the fourth transmission gear 87 is disposed on the upper side of the first transmission gear 84, the fourth transmission gear does not mesh with the first transmission gear 84, and a gap is provided between the first transmission gear and the fourth transmission gear.

Thus using a configuration in which the drive of the first transmission gear 84 is transmitted to the fourth transmission gear 87 via the second transmission gear 85 and the third transmission gear 86 allows the upper feed roll 24 and the lower feed roll 25 each to rotate in the reverse direction.

As shown in FIG. 5, the feeder drive motor unit 81 is connected to the feeder controller 20 via a drive unit 88 and a positioning unit 89. The drive unit 88 is a servo amplifier, and controls the motor 81*a*. The positioning unit 89 is a servo controller, senses the rotational position of the motor 81*a* on the basis of a pulse from the PG 81*b*, and transmits a command to the drive unit 88.

In performing press forming, it is necessary to intermittently feed the coiled material 100 to the pressing machine side in accordance with the pressing operation, and the amount by which the coiled material 100 is fed here needs to be accurate. Therefore, the upper feed roll 24 and the lower feed roll 25 are rotationally driven by a servo motor such as the feeder drive motor unit 81.

1-4-6. Meandering Detector 29

Figure 8:
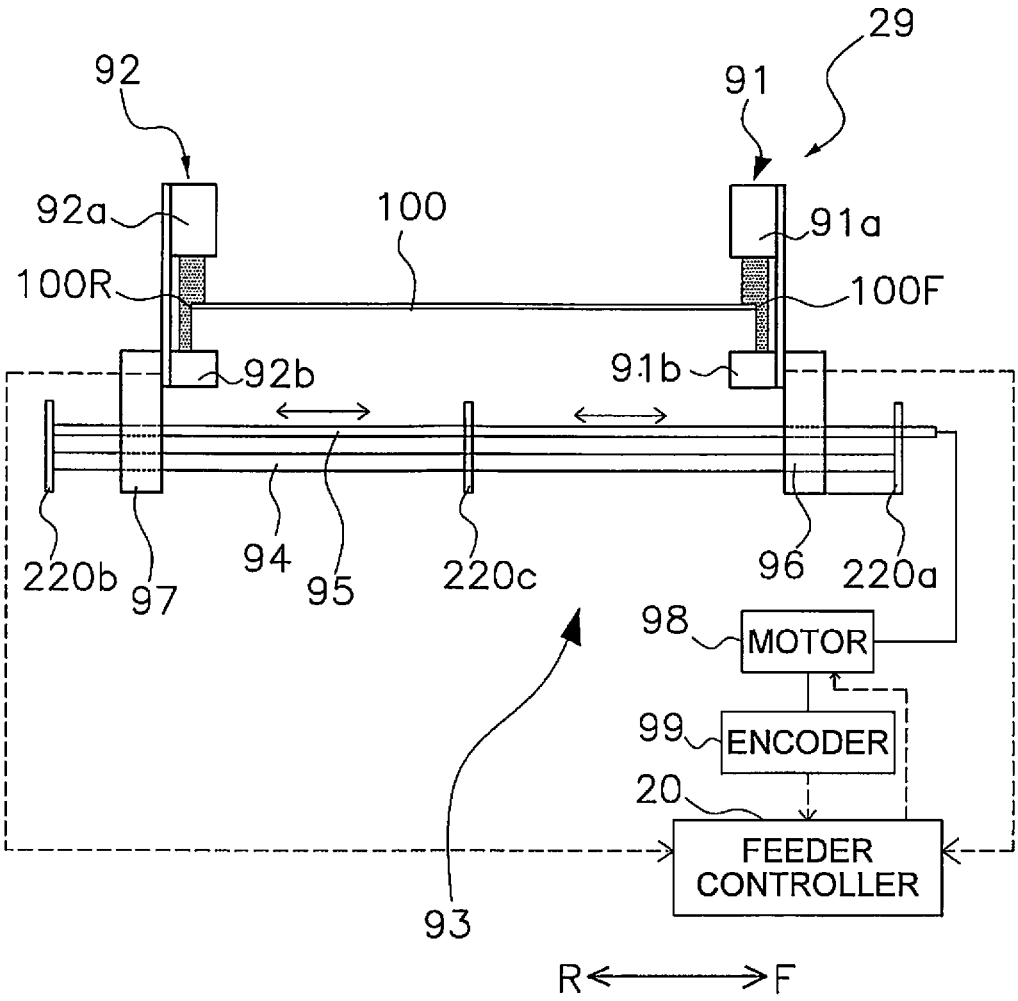
FIG. 8 is a simplified view of the configuration of a meandering detector of the leveler feeder in FIG. 3.

The meandering detector 29 detects meandering of the coiled material 100 conveyed by the upper feed roll 24 and the lower feed roll 25. FIG. 8 is a simplified diagram of the meandering detector 29, and is a view of the meandering detector 29 as seen from the downstream direction X side. As shown in FIGS. 3 and 8, the meandering detector 29 has a first laser sensor 91, a second laser sensor 92, and a drive mechanism 93.

As shown in FIGS. 3 and 6, the first laser sensor 91 and the second laser sensor 92 are laser-based displacement sensors, which are provided in the front-rear direction (the arrow FR direction) of the distal end of the table 210. The table 210 is provided on the downstream direction X side of the housing 200. The table 210 is disposed such that the position of its upper face in the height direction is more or less between the upper feed roll 24 and the lower feed roll 25. The table 210 is provided with a plurality of free rolls, and the coiled material 100 conveyed from the upper feed roll 24 and the lower feed roll 25 is supported from below so as to be guided to a pressing machine or the like.

As shown in FIG. 3, the first laser sensor 91 is disposed at a position closer to the front direction F side of the distal end of the table 210, and has, as shown in FIG. 8, a projector 91*a* from which a laser beam is projected and a light receiver 91*b* that receives the projected laser beam. The light projector 91*a* is disposed above the light receiver 91*b*. The first laser sensor 91 senses the position of a first end 100F on the front direction F side of the coiled material 100 when the laser beam is blocked by the coiled material 100 passing between the light projector 91*a* and the light receiver 91*b*. As shown in FIG. 5, the detection value of the first laser sensor 91 is transmitted to the feeder controller 20 via an amplifier 101.

As shown in FIG. 3, the second laser sensor 92 is disposed at a position closer to the rear direction R side of the distal end of the table 210, and as shown in FIG. 8, has a projector 92*a* from which a laser beam is projected, and a light receiver 92*b* that receives the projected laser beam. The projector 92*a* is disposed above the light receiver 92*b*. The second laser sensor 92 senses the position of a second end 100R on the backward direction R side of the coiled material 100 when the laser beam is blocked by the coiled material 100 passing between the light projector 92*a* and the light receiver 92*b*. As shown in FIG. 5, the detection value of the second laser sensor 92 is transmitted to the feeder controller 20 via an amplifier 102.

Thus using laser-based displacement sensor allows the positions of the first end 100F and the second end 100R of the coiled material 100 to be sensed, and makes it possible to measure how much the position of the coiled material 100 has moved in the width direction of the coiled material 100 (also referred to as the front-rear direction).

The drive mechanism 93 moves the first laser sensor 91 and the second laser sensor 92 in the front-rear direction (the arrow FR direction) to match the width of the coiled material 100 being conveyed.

As shown in FIG. 8, the drive mechanism 93 has a guide rod 94 disposed along the front-rear direction, a ball screw 95 disposed along the front-rear direction, a first slider 96 and a second slider 97 that are able to move in the front-rear direction along the guide rod 94, a motor 98, and an encoder 99.

As shown in FIGS. 3 and 6, the guide rod 94 and the ball screw 95 are fixed to the table 210 via fixing members 220*a*, 220*b*, and 220*c*. The fixing members 220*a*, 220*b*, and 220*c* are disposed along the front-rear direction, and the fixing member 220*a* is disposed near the distal end of the table 210 and more on the front direction F side than the table 210. The fixing member 220*b* is disposed near the distal end of the table 210 and more on the rear direction R side than the table 210. The fixing member 220*c* is disposed in the center position in the front-rear direction.

As shown in FIG. 8, the first laser sensor 91 is fixed to the upper part of the first slider 96. A bushing is provided to the first slider 96, and the guide rod 94 is inserted through this bushing. Also, a nut is provided to the first slider 96, and the ball screw 95 is threaded into this nut.

The second laser sensor 92 is fixed to the upper part of the second slider 97. A bushing is provided to the second slider 97, and the guide rod 94 is inserted into this bushing. Also, a nut is provided to the second slider 97, and the ball screw 95 is threaded into this nut.

Also, the ball screw 95 is reverse-threaded in the front-rear direction (the arrow FR direction) using the fixing member 220*c* as a reference.

The ball screw 95 is rotatably supported by the fixing members 220*a*, 220*b*, and 220*c*, and is rotated by the motor 98 as shown in FIG. 8. The rotation of the ball screw 95 causes the first slider 96 and the second slider 97 screwed meshed with the ball screw 95 to move in the front-rear direction. The positions of the first slider 96 and the second slider 97 are sensed by the encoder 99, and the feeder controller 20 moves the first slider 96 and the second slider 97 to match the width of the coiled material 100 that has been placed in the uncoiler 3.

With this configuration, when the motor 98 is driven, the first laser sensor 91 and the second laser sensor 92 move symmetrically with respect to the fixing member 220*c*, which is the center position in the front-rear direction.

1-5. Control Configuration

FIG. 9 is a block diagram of the control configuration of the coil line system 1 in this embodiment. As shown in FIG. 9, the system controller 5 transmits a control command to the uncoiler controller 34 of the uncoiler 3, the passing controller 45 of the coiled material passing device 4, and the feeder controller 20 of the leveler feeder 2.

The uncoiler controller 34 controls the drive mechanism 33 and the hold-down roll 32. The passing controller 45 controls the clamping driver 42 and the catenary driver 44.

The feeder controller 20 accepts information related to the width of the coiled material 100 placed in the uncoiler 3 from the system controller 5, and drives the motor 98 and moves the first laser sensor 91 and the second laser sensor 92 on the basis of information related to the width of the coiled material 100 and the detection value from the encoder 99.

The feeder controller 20 controls the feeder drive motor unit 81 via the drive unit 88 on the basis of the rotational position determined by the positioning unit 89, and intermittently rotates the upper feed roll 24 and the lower feed roll 25. As a result, the coiled material 100 is intermittently fed to the pressing machine.

When meandering is detected on the basis of the detection result of the first laser sensor 91 received via the amplifier 101 and the detection result of the second laser sensor 92 received via the amplifier 102, the feeder controller 20 controls the first electro-pneumatic regulator 63, the second electro-pneumatic regulator 64, the first switching valve 65, the second switching valve 66, and the pump 67 so as to correct this meandering.

2. Operation

The operation of the leveler feeder 2 in an embodiment of the present invention will now be described, and also an example of the coiled material conveyance method of the present invention will be discussed at the same time.

Figure 10:
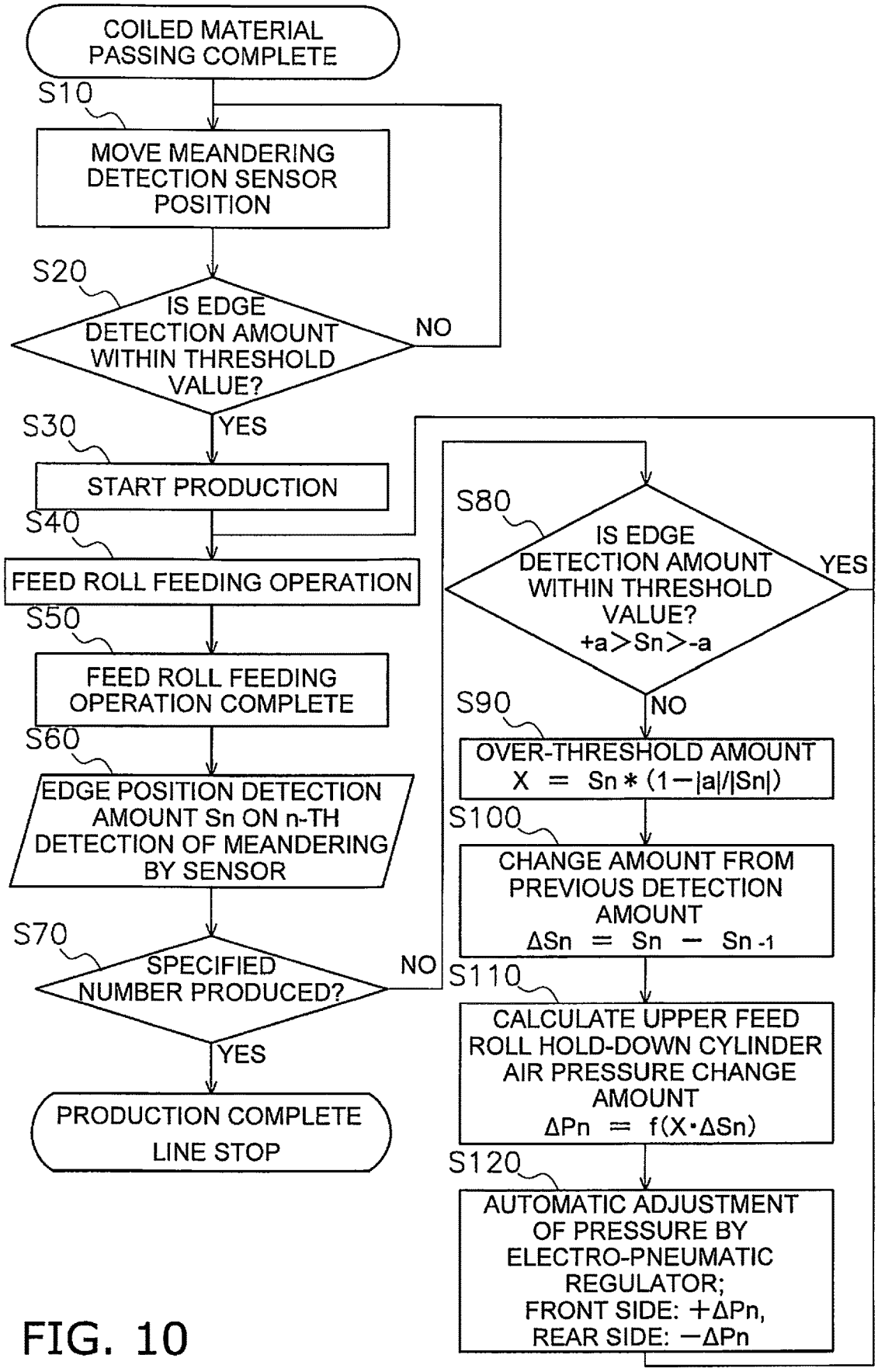
FIG. 10 is a flowchart of the operation of the leveler feeder in FIG. 3.

FIG. 10 is a flowchart of the operation of the leveler feeder 2 in this embodiment.

When the coiled material 100 is placed in the uncoiler 3, passage of the coiled material 100 to the leveler feeder 2 is carried out. This operation is performed by having the coiled material passing device 4 clamp the distal end of the coiled material 100 with the clamper 41, and having the catenary component 43 move to the leveler feeder 2 side.

Next, in step S10, the feeder controller 20 drives the motor 98 to move the first laser sensor 91 and the second laser sensor 92 (meandering detectors) to a position matching the width of the coiled material 100 being passed. The width of the coiled material 100 placed in the uncoiler 3 is inputted by the operator on the control panel. The system controller 5 transmits information about the inputted width, thickness, material, etc. of the coiled material 100 to the feeder controller 20, and the feeder controller 20 adjusts the positions of the first laser sensor 91 and the second laser sensor 92 on the basis of the received information about the width of the coiled material 100.

In step S20, the feeder controller 20 determines whether or not the positions of the first end 100F and the second end 100R of the coiled material 100 sensed by the first laser sensor 91 and the second laser sensor 92 are within a specific threshold range. If they are not within the specific threshold range, the positions of the first laser sensor 91 and the second laser sensor 92 are adjusted. If the positions of the first end 100F and the second end 100R of the coiled material 100 do not fall within the specific threshold range after repeated adjustment, then the machine may be adjusted or the passing operation may be performed again.

The determination criterion in step S20 may be the same as the determination criterion in step S80 (discussed below). That is, if we let the specific threshold value be ±a, and if the edge position detection amount $S_0$ after passing, which is the amount of deviation of the coiled material 100 from a specific conveyance position after passing, is a positive value when shifted to the front direction F side and a negative value when shifted in the rear direction R, the feeder controller 20 determines whether or not the following Formula 1 is satisfied.

$$+a > S_0 > -a \qquad \text{Formula 1}$$

In step S20, when the first end 100F and the second end 100R of the coiled material 100 are within the specific threshold range, the coiled material 100 is sent in the downstream direction X and is in a state that allows it to be made into a product, and production is started by an operation by the operator.

When production is started in step S30, in step S40 the feeder controller 20 performs a feed roll feeding operation. The feed amount of the coiled material 100 is set on the basis of the product to be produced, and the feeder controller 20 receives information about the feed amount from the system controller 5. Then upper feed roll 24 and the lower feed roll 25 are then rotated so as to move the coiled material 100 by a specific feed amount. The feeder controller 20 rotates the motor 81*a* via the drive unit 88 while sensing the position of the motor 81*a* with the positioning unit 89 on the basis of the pulse generated from the PG 81*b*. Consequently, the feeder controller 20 rotates the upper feed roll 24 and the lower feed roll 25 more accurately.

In step S40, the feeder controller 20 controls the first electro-pneumatic regulator 63 and the second electro-pneumatic regulator 64 to apply an initial pressure $P_0$ to the first end 24F and the second end 24R of the upper feed roll 24. If we let $P_{Fn}$ be the pressure applied to the first end 24F, and $P_{Rn}$ be the pressure applied to the second end 24R, $P_{Fn}$ and $P_{Rn}$ are both set to $P_0$.

At this pressure $P_0$, the upper feed roll 24 presses the coiled material 100 against the lower feed roll 25, and when the upper feed roll 24 and the lower feed roll 25 rotate, the coiled material 100 can be fed toward the pressing machine side. The initial pressure $P_0$ is preset as dictated by the material, thickness, and so forth of the coiled material 100 received by the feeder controller 20 from the system controller 5.

When the upper feed roll 24 and the lower feed roll 25 are rotated by a specific feed amount, the feeder controller 20 stops the rotation of the upper feed roll 24 and the lower feed roll 25 (step S50). This concludes one feed roll feed operation.

Next, in step S60, the feeder controller 20 senses the positions of the first end 100F and the second end 100R of the coiled material 100 with the first laser sensor 91 and the second laser sensor 92. Also, the feeder controller 20 remembers how many times this detection has been made. Since the detection of the ends 100F and 100R of the coiled material 100 is carried out each time the coiled material 100 is fed, the feed number n of the coiled material 100 matches the detection number n. The n-th edge position detection amount $S_n$ is detected as the amount of deviation (also referred to as the meandering amount) from a specific conveyance position in the width direction (front-rear direction; the arrow FR direction) after the coiled material 100 has been fed n times. The edge position detection amount $S_n$ may be the average value of the detection amounts produced by the first laser sensor 91 and the second laser sensor 92. In the flowchart shown in FIG. 10, the value is positive when shifted to the front direction F side, and is negative when shifted in the rear direction R.

Next, in step S70, the feeder controller 20 determines whether or not a specific, preset number of productions has ended, and if not, the control proceeds to step S80.

In step S80, the feeder controller 20 determines whether or not the positions of the first end 100F and the second end 100R of the coiled material 100 detected by the first laser sensor 91 and the second laser sensor 92 are within a specific threshold value a. As described above, the amount is positive when the shift is to the front direction F side, and is negative when the shift is in the rear direction R, so the feeder controller 20 determines whether or not it the following Formula 1 is satisfied. The specific threshold value a is set to a value within the allowable range.

$$+a > S_n > -a \text{ (a is a positive constant)} \qquad \text{Formula 1}$$

When Formula 1 is satisfied, it is determined that the meandering of the coiled material 100 is within the allowable range, the control proceeds to step S40, and the feeder controller 20 drives the upper feed roll 24 and the lower feed roll 25 to perform the next (n+1-th) feed operation.

On the other hand, if the above Formula 1 is not satisfied, control proceeds to step S90, and meandering correction control is performed.

In step S90, the feeder controller 20 calculates the amount by which the threshold is exceeded on the basis of the following Formula 2.

$$X=S_n\times(1-|a|/|S_n|) \quad \text{Formula 2}$$

The above Formula 2 is used to calculate the amount X by which the edge position detection amount $S_n$ exceeds the threshold value after the coiled material 100 has been fed the n-th time. The over-threshold amount X is a positive value when the offset is to the forward direction F side, and is a negative value when the offset is to the rear direction R side.

Next, in step S100, the feeder controller 20 uses the following Formula 3 to calculate the amount of change in the detection amount the (n−1)-th time and the detection amount the n-th time. Here, the edge position detection amount $S_{n-1}$ the (n−1)-th time is stored by the feeder controller 20.

$$\Delta S_n=S_n-S_{n-1} \quad \text{Formula 3}$$

After the coiled material 100 is fed the first time, $\Delta S_1=S_1-S_0$, but $S_0$ may be the edge position detection amount detected in step S20.

Next, in step S110, the feeder controller 20 calculates a change amount $\Delta P_n$ in the air pressure of the first air cylinder 61 and the second air cylinder 62 that apply pressure to the upper feed roll 24 on the basis of the following Formula 4.

$$\Delta P_n=f(X\cdot\Delta S_n) \quad \text{Formula 4}$$

The above Formula 4 is a function of the over-threshold amount X and the change amount $\Delta S_n$ in meandering. This function will be discussed later in detail.

The control then goes back to step S40, and the pressure changed by $\Delta P_n$ from the pressure when the coiled material was fed the n-th time is applied when the coiled material is fed the n+1-th time (also referred to as during the feed roll feeding operation).

More precisely, in step S120, the feeder controller 20 adjusts the first electro-pneumatic regulator 63 to increase the pressure applied by the first air cylinder 61 to the first end 24F by $\Delta P_n$ over the pressure applied when the coiled material 100 is fed the n-th time.

Here, if we let $P_{Fn}$ be the pressure applied to the first end 24F during feed of the coiled material the n-th time, we obtain $P_{Fn}=P_0+\Delta P_1+\Delta P_2+\ldots+\Delta P_{n-1}$.

The $\Delta P_n$ calculated in Formula 4 is the change amount after the coiled material is fed the n-th time, so in the next step S40, the pressure $PF_{n+1}$ applied to the first end 24F when the coiled material is fed the (n+1)-th time is $P_0+\Delta P_1+\Delta P_2+\ldots+\Delta P_{n-1}+\Delta P_n$. That is, the pressure $PF_{n+1}$ is the sum of adding the initial value $P_0$ to the change amounts from the first time to the n-th time. In other words, the adjustment amount $S\Delta P_n$ from the initial value $P_0$ of the pressure $PF_{n+1}$ is $\Delta P_1+\Delta P_2+\ldots+\Delta P_n$.

Also, the feeder controller 20 adjusts the second electro-pneumatic regulator 64 to decrease the pressure applied by the second air cylinder 62 to the second end 24R of the upper feed roll 24 by $\Delta P_n$ less than the pressure applied when the coiled material is fed the n-th time.

Here, if we let $PR_n$ be the pressure applied to the second end 24R when the coiled material is fed the n-th time, then $PR_n=P_0-\Delta P_1-\Delta P_2\ldots P_{n-1}$, and the adjustment amount from the initial value $P_0$ the (n+1)-th time is $-\Delta P_1-\Delta P_2\ldots P_n$, which is $-S\Delta P_n$.

That is, the pressure applied to the first end 24F when the coiled material 100 is fed the (n+1)-th time is $PF_{n+1}=P_0+S\Delta P_n$, and the pressure applied to the second end 24R is $PR_{n+1}=P_0-S\Delta P_n$.

Incidentally, $\Delta P_n$ can take either a positive or a negative value, so when $\Delta P_n$ is a negative value, the pressure applied to the first end 24F when the coiled material is fed the (n+1)-th time is decreased below the pressure the n-th time, and the pressure applied to the second end 24R is increased over the pressure the n-th time.

Thus, in step S40, $PF_{n+1}$ $(=P_0+S\Delta P_n)$ is applied to the first end 24F during feed of the coiled material the n+1-th time, and $PR_{n+1}$ $(=P_0-S\Delta P_n)$ is applied to the second end 24R. When the feed operation is completed in step S50, the first laser sensor 91 and the second laser sensor 92 sense the edge position detection amount the (n+1)-th time (the amount of offset at the first end 100F and the second end 100R of the coiled material 100), and the number of (n+1) times detected is stored in the feeder controller 20.

Next, in step S70, it is determined whether or not the specified production number has been completed, and if the answer is yes, the coil line system 1 is stopped. On the other hand, if the produced number does not reach the specified number, steps S80 to S120 are performed again.

That is, every time the coiled material 100 is fed, the coiled material 100 is checked for meandering by the meandering detector 29, and the front-rear pressure applied to the upper feed roll 24 is adjusted so as to correct the meandering on the basis of this result.

Figure 11:
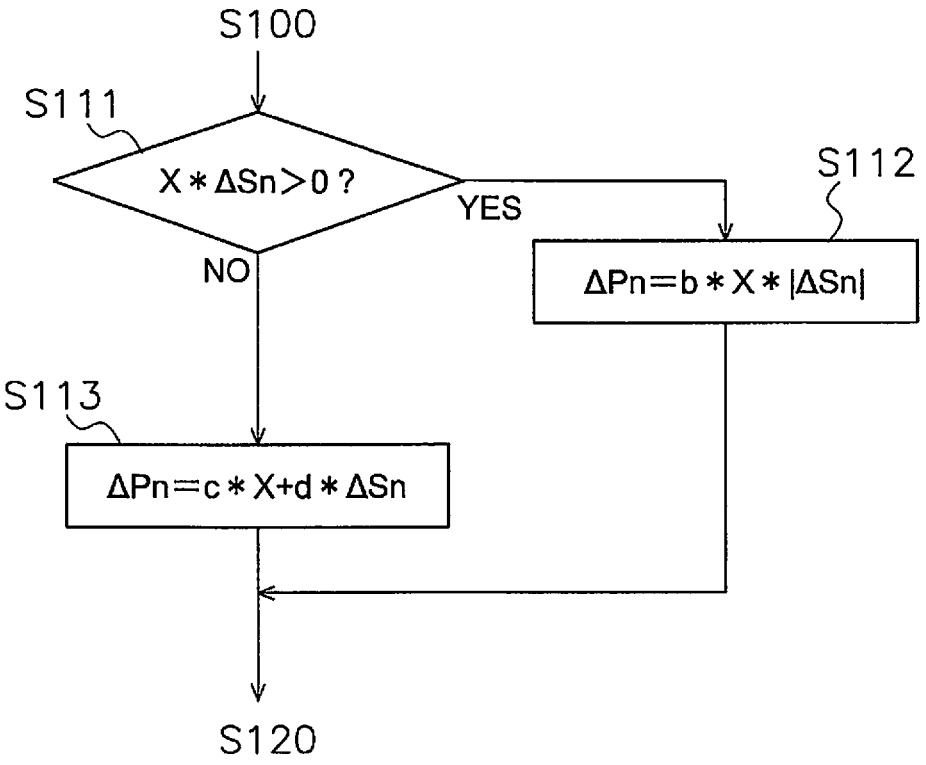
FIG. 11 is a flowchart of the operation of the leveler feeder in FIG. 3.

Next, the calculation of the change amount $\Delta P_n$ in step S110 will be described in detail. FIG. 11 is a flowchart of the operation for calculating the pressure change amount.

After the step S100 discussed above, in step S111 the feeder controller 20 determines whether or not the following Formula 5 is satisfied.

$$X\times\Delta S_n>0 \quad \text{Formula 5}$$

If Formula 5 is satisfied, since the product of multiplying the over-threshold amount X by the change amount $\Delta S_n$ in the detected amount $S_n$ the n-th time from the detected amount $S_{n-1}$ the n−1-th time is greater than 0, this indicates that meandering progressing. For example, when meandering is progressing on the front direction F side, the over-threshold amount X the n-th time is a positive value, $S_n$ and $S_{n-1}$ are also positive values, and $S_n$ is greater than $S_{n-1}$. Also, when meandering is progressing on the rear direction R side, the over-threshold amount X the n-th time is a negative value, $S_n$ and $S_{n-1}$ are also negative values, $S_n$ is less than $S_{n-1}$, and $\Delta S_n$ is also a negative value.

Therefore, when meandering is progressing, the above-mentioned Formula 5 is satisfied.

If it is determined in step S111 that meandering is progressing, in step S112 the feeder controller 20 calculates $\Delta P_n$ using the following Formula 6.

$$\Delta P_n=b\times X\times|\Delta S_n|\ (b \text{ is a positive constant}) \quad \text{Formula 6}$$

The change amount $\Delta P_n$ can be calculated with this formula. Here, from Formula 6, the adjustment amount $S\Delta P_n$ from the initial value $P_0$ of the pressure during feed of the coiled material the n+1-th time is increased over the adjustment amount $S\Delta P_{n-1}$ from the initial value $P_0$ the n-th time. Also, from Formula 6, the change amount $\Delta P_n$ during feed of the coiled material the n+1-th time can be said to be based on the over-threshold amount X and the change amount $\Delta S_n$ in the edge position detection amount $S_n$ the n-th time.

For example, when meandering is progressing on the front direction F side, the over-threshold amount X after feed of the coiled material the n-th time is a positive value, and $|\Delta S_n|$ is also a positive value, so $\Delta P_n$ is positive. Therefore, as shown in step S120, the pressure applied to the first end 24F is increased by $\Delta P_n$, and the pressure applied to the second end 24R is decreased by $\Delta P_n$. Thus, movement of the coiled material 100 to the first end 24F side can be suppressed by increasing the pressure at the first end 24F and decreasing the pressure at the second end 24R.

Also, when meandering is progressing on the rear direction R side, for example, the over-threshold amount X after feeding the coiled material the n-th time is a negative value, and $|\Delta S\ n|$ is a positive value, so $\Delta P_n$ is negative. Therefore, as shown in step S120, the pressure applied to the first end 24F is decreased by $\Delta P_n$, and the pressure applied to the second end 24R is increased by $\Delta P_n$. Thus, movement of the coiled material 100 to the second end 24R side can be suppressed by increasing the pressure at the second end 24R and decreasing the pressure at the first end 24F.

If Formula 5 is not satisfied in step S111, meandering is not progressing, so it is determined that the progress of meandering has stopped or the amount of meandering is decreasing. Here, saying that the progress of meandering has stopped means, for example, that the edge position detection amount $S_n$ after the coiled material 100 has been fed the n-th time is the same as the edge position detection amount $S_{n-1}$ after the coiled material 100 has been fed the n−1-th time. Also, saying that the amount of meandering is decreasing means that the edge position detection amount $S_n$ is closer to the threshold value ±a than the edge position detection amount $S_{n-1}$.

Then, in step S113 the feeder controller 20 calculates the change amount $\Delta P_n$ the n-th time by using the following Formula 7.

$$\Delta P_n = c \times X + d \times \Delta S_n \text{ (}c\text{ and }d\text{ are positive constants)} \qquad \text{Formula 7}$$

According to Formula 7, $\Delta P_n$ can be either positive or negative according to the magnitude of the change amount $\Delta S_n$ in the edge position detection amount $S_n$ the n-th time and the over-threshold amount X. That is, the adjustment amount $S\Delta P_n$ from the initial value $P_0$ of the pressure during feed of the coiled material the n+1-th time increases or decreases with respect to the adjustment amount $S\Delta P_{n-1}$ from the initial value $P_0$ the n-th time.

The first term (c×X) in Formula 7 is proportional to the magnitude of the over-threshold amount X, and its positive or negative sign matches that of X. The second term ($d \times \Delta S_n$) is proportional to magnitude of the change amount $\Delta S_n$, and its positive or negative sign matches that of $\Delta S_n$.

Also, for example, a case will be described in which there is a large amount of meandering on the front direction F side, and the edge position detection amount $S_n$ is moving closer to the threshold value ±a than the edge position detection amount $S_{n-1}$ due to the correction action, but the change amount $\Delta S_n$ is small (a case in which the correction action is small and only a small amount of the coiled material 100 moves toward inside the threshold range after being fed for the n-th time).

The first term (c×X) in Formula 7 is a positive value and increases in proportion to X, and the second term ($d \times \Delta S_n$) is a negative value and decreases in proportion to $\Delta S_n$. $\Delta P_n$ is generally a positive value, although this can vary depending on the magnitude of c and d. That is, the pressure is changed in the direction of strengthening the correction.

A case will be describe in which there is a small amount of meandering on the front direction F side, the edge position detection amount $S_n$ is moving closer to the threshold ±a than the edge position detected value $S_{n-1}$ due to the correction action, and the change amount $\Delta S_n$ is large (a case in which the correction action is large and the coiled material 100 largely has moved considerably toward being inside the threshold range after being fed for the n-th time).

The first term (c×X) in Formula 7 is a positive value and decreases in proportion to X, and the second term ($d \times \Delta S_n$) is a negative value and increases in proportion to $\Delta S_n$. Therefore, $\Delta P_n$ is generally a negative value, and the pressure is changed in the direction of weakening the correction.

Consequently, the meandering correction is further strengthened at a stage where the over-threshold amount X is still large even after correction has been performed, and conversely, if the change amount $\Delta S_n$ becomes too large, the change amount $\Delta P_n$ can be determined so as to weaken the correction so that there will be no meandering on the opposite side. Therefore, it is possible to eliminate a meandering state more quickly and to prevent meandering to the opposite side due to over-correction.

For example, when meandering of the coiled material 100 is not progressing due to the action of correction, and the edge position detection amount $S_n$ is the same as the edge position detection amount $S_{n-1}$, the first term in Formula 7 (c×X) is a positive value and the second term is 0, so $\Delta P_n$ is positive. That is, the pressure is changed in the direction of further strengthening the correction.

Also, in the process in which the edge position detection amount $S_n$ approaches the range of the threshold ±a due to correction, if the positive value of the first term (c×X) and the negative value of the second term ($d \times \Delta S_n$) in Formula 7 have the same absolute value, then the adjustment amount from the initial value $P_0$ during feed of the coiled material the n+1-th time will be the same as the adjustment amount during feed of the coiled material the n-th time.

Also, the above a, b, c, and d may be found in advance according to the material and the thickness of the coiled material or the like, or may be adjusted in test pressing or the like.

As described above, while meandering is happening, when the adjustment amount from the initial value is increased to suppress the meandering and the meandering starts to be corrected, and while meandering correction is in progress, the adjustment amount from the initial value is increased or decreased according to the magnitude of the change amount $\Delta S_n$ and the over-threshold amount X.

Thus, meandering can be corrected accurately by adjusting the pressure separately when meandering is in progress, when meandering starts to be corrected, and when meandering correction is in progress.

3. Features, Etc.

(3-1)

The leveler feeder 2 (an example of a roll feeder) pertaining to this embodiment is a roll feeder that intermittently feeds the coiled material 100, and comprises the paired upper feed roll 24 (an example of a first roll) and lower feed roll 25 (an example of a second roll), the pressing component 27, the meandering detector 29, and the feeder controller 20 (an example of a controller). The paired upper feed roll 24 and lower feed roll 25 are disposed so as to clamp the coiled material 100 and to feed the coiled material 100 in the conveyance direction. The meandering detector 29 detects movement of the coiled material 100 from a specific conveyance position in the front-rear direction (an example of the width direction) perpendicular to the conveyance direction of the coiled material 100. The pressing component 27 presses the upper feed roll 24 against the coiled material 100 being conveyed. The feeder controller 20 controls the pressing component 27 so as to correct meandering on the basis of detection by the meandering detector 29.

Thus, meandering of the coiled material 100 can be corrected by controlling the pressing component 27 on the basis of the detection by the meandering detector 29. Therefore, the operator does not have to constantly monitor the process, nor does the operator have to go into the machine, meandering can be easily corrected.

In this embodiment, the specific conveyance position is set in the center position in the front-rear direction (the arrow FR direction). For example, the specific conveyance position of the coiled material 100 can be set to a position where the center in the front-rear direction (which can also be called the width direction) coincides with the position of the fixing member 220*c* shown in FIG. 3, etc.

(3-2)

With the leveler feeder 2 (an example of a roll feeder) pertaining to this embodiment, the pressing component 27 has the first air cylinder 61 (an example of a first pressure applicator) and the second air cylinder 62 (an example of a second pressure applicator). The first air cylinder 61 is linked to the first end 24F (an example of the first end) side of the upper feed roll 24, and applies pressure to the first end 24F so as to press on the coiled material 100 being conveyed. The second air cylinder 62 is linked to the second end 24R (an example of the second end) side of the upper feed roll 24 and applies pressure to the second end 24R so as to press on the coiled material 100 being conveyed. The feeder controller 20 controls the first air cylinder 61 and the second air cylinder 62 to adjust the pressing force of the first end 24F and the second end 24R against the coiled material 100 and thereby correct meandering.

Thus, meandering of the coiled material 100 toward the first end 24F side or the second end 24R side can be corrected by adjusting the pressure applied to the first end 24F and the second end 24R of the upper feed roll 24.

(3-3)

With the leveler feeder 2 (an example of a roll feeder) pertaining to this embodiment, the meandering detector 29 detects the edge position detection amount $S_n$ (an example of a meandering amount) by which the coiled material 100 has deviated from the specific conveyance position toward the first end 24F or the second end 24R. The feeder controller 20 controls the pressing component 27 so that when the meandering detector 29 has detected that the coiled material 100 has moved by more than a specific threshold value a from the specific conveyance position toward the first end 24F, the pressure applied to the first end 24F is increased and the pressure applied to the second end 24R is decreased, and when the meandering detector 29 has detected that the coiled material 100 has moved by more than a specific threshold value −a from the specific conveyance position toward the second end 24R, the pressure applied to the second end 24R is increased and the pressure applied to the first end 24F is decreased.

Consequently, when the coiled material 100 has deviated beyond a specific threshold value a from the specific conveyance position toward the first end 24F, or beyond the specific threshold value −a from the specific conveyance position toward the second end 24R, this meandering can be corrected. The specific threshold value a and the specific threshold value −a can be set to a range over which deviation of the coiled material 100 from the specific conveyance position is allowable.

(3-4)

With the leveler feeder 2 (an example of a roll feeder) pertaining to this embodiment, when the pressure applied to the first end 24F is increased, the feeder controller 20 reduces the pressure from the initial value $P_0$ predetermined for the second end 24R (an example of a second pressure setting value) by the adjustment amount $S\Delta P_n$ for increasing the pressure from the initial value $P_0$ predetermined for the first end 24F (an example of a first pressure setting value). When the pressure applied to the second end 24R is increased, the feeder controller 20 reduces the pressure from the initial value $P_0$ predetermined for the first end 24F (an example of a first pressure setting value) by the adjustment amount $S\Delta P_n$ for increasing the pressure from the initial value $P_0$ predetermined for the second end 24R (an example of a second pressure setting value).

Thus, when the pressing force toward the first end 24F side of the coiled material 100 is increased by the specific amount $S\Delta P_n$, the pressing force toward the second end 24R side is decreased by the same amount. Also, when the pressing force toward the second end 24R side of the coiled material 100 is increased by the specific amount $S\Delta P_n$, the pressing force toward the first end 24F side is decreased by the same amount.

This prevents rolling of the coiled material 100 under too much pressing force by the upper feed roll 24.

(3-5)

With the leveler feeder 2 (an example of a roll feeder) pertaining to this embodiment, the feeder controller 20 sets the adjustment amount $S\Delta P_n$ on the basis of how much the edge position detection amount $S_n$ (an example of a meandering amount) of the coiled material 100 exceeds the specific threshold value a or the specific threshold value −a.

This makes it possible to control so that the adjustment amount $S\Delta P_n$ is increased as the amount by which the edge position detection amount $S_n$ exceeds the specific threshold ±a increase, for example.

(3-6)

With the leveler feeder 2 (an example of a roll feeder) pertaining to this embodiment, the feeder controller 20 sets the adjustment amount $S\Delta P_n$ during feed of the coiled material the n+1-th time on the basis of the edge position detection amount $S_{n-1}$ during feed of the coiled material 100 the n−1-th time (n is a natural number of 1 or more) and the change amount $\Delta S_n$ in the edge position detection amount $S_n$ during feed of the coiled material the n-th time.

This makes it possible to change the adjustment amount of the pressure during the next feed of the coiled material on the basis of the change amount in the meandering amount during the current feed of the coiled material 100 and the meandering amount during the previous feed of the coiled material 100.

(3-7)

With the leveler feeder 2 (an example of a roll feeder) pertaining to this embodiment, the feeder controller 20 compares the edge position detection amount $S_{n-1}$ during feed of the coiled material 100 the n−1-th time to the edge position detection amount $S_n$ during feed of the coiled material 100 the n-th time, and if it is determined that the edge position detection amount $S_n$ of the coiled material 100 is increasing, the adjustment amount $S\Delta P_n$ during feed of the coiled material the n+1-th time is increased as compared to the adjustment amount $S\Delta P_{n-1}$ during feed of the coiled material the n-th time.

Thus, if edge position detection value $S_n$ during feed of the coiled material the n-th time is increasing as compared to the edge position detection value $S_{n-1}$ during feed of the coiled material the n−1-th time, it can be concluded that meandering is progressing, so the adjustment amount $S\Delta P_n$ during the next feed of the coiled material 100 is set to be greater than the $S\Delta P_{n-1}$ during feed of the coiled material the n-th time. That is, if, for example, the pressure applied to the first end 24F of the upper feed roll 24 during the current feed of the coiled material is increased by a specific amount and the pressure applied to the second end 24R is decreased by a specific amount, then the pressing component 27 is controlled so that the next time, the pressure applied to the first end 24F is further increased and the pressure applied to the second end 24R is further decreased.

This makes it less likely that meandering will proceed.

(3-8)

With the leveler feeder 2 (an example of a roll feeder) pertaining to this embodiment, the feeder controller 20 increases the adjustment amount $S\Delta P_n$ during feed of the coiled material the n+1-th time on the basis of the change amount $\Delta S_n$ of the edge position detection amount $S_n$ the n-th time and the over-threshold value X (an example of an exceed amount) by which the edge position detection amount $S_n$ of the coiled material 100 has exceeded the threshold value ±a.

This allows the amount by which the adjustment amount is increased to be adjusted.

(3-9)

With the leveler feeder 2 (an example of a roll feeder) pertaining to this embodiment, the feeder controller 20 compares the edge position detection amount $S_{n-1}$ during feed of the coiled material 100 the n−1-th time to the edge position detection amount $S_n$ during feed of the coiled material 100 the n-th time, and if it is determined that the increase in the edge position detection amount $S_n$ of the coiled material 100 has stopped or that the edge position detection amount $S_n$ is decreasing, the adjustment amount $S\Delta P_n$ during feed of the coiled material the n+1-th time is set on the basis of the change amount $\Delta S_n$ in the edge position detection amount $S_n$ the n-th time and the over-threshold amount X by which the edge position detection amount $S_n$ of the coiled material 100 has exceeded the specific threshold value ±a.

Consequently, the meandering correction is further strengthened at a stage where the over-threshold amount X is still large even after correction has been performed, and conversely, if the change amount $\Delta S_n$ becomes too large, the change amount $\Delta P_n$ can be determined so as to weaken the correction so that there will be no meandering to the opposite side. Therefore, it is possible to eliminate a meandering state more quickly and to prevent meandering to the opposite side due to over-correction.

From Formula 7, when the quotient ($X/\Delta S_n$) obtained by dividing the over-threshold amount X by the change amount $\Delta S_n$ is greater than a specific value (−d/c) (when $X/\Delta S_n > -d/c$), $\Delta P_n$ is a positive value, and the adjustment amount $S\Delta P_n$ during feed of the coiled material the n+1-th time increases more than the adjusting amount $S\Delta P_n$ during feed of the coiled material the n-th time.

Also, when $X/\Delta S_n = -d/c$, $\Delta P_n$ is zero, and the adjustment amount $S\Delta P_n$ during feed of the coiled material the n+1-th time has the same value as the adjustment amount $S\Delta P_{n-1}$ the n-th time.

Also, when $X/\Delta S_n < -d/c$, $\Delta P_n$ is a negative value, and the adjustment amount $S\Delta P_n$ during feed of the coiled material the n+1-th time is reduced more than the adjustment amount $S\Delta P_{n-1}$ the n-th time.

(3-10)

With the leveler feeder 2 (an example of a roll feeder) in this embodiment, the meandering detector 29 has the first laser sensor 91 and the second laser sensor 92 disposed on both sides in the width direction.

Consequently, the amount of positional deviation at the positions of both ends 100F and 100R in the front-rear direction (width direction) of the coiled material 100 can be sensed, and the pressing component 27 can be controlled on the basis of this sensed value.

(3-11)

The coiled material conveyance method pertaining to this embodiment is a coiled material conveyance method for intermittently feeding the coiled material 100, comprising a step S40 (an example of a feed step), a step S50 (an example of a stoppage step), a step S60 (an example of a meandering detection step), and steps S80 to S120 (pressure adjustment steps). In step S40 (an example of a feed step), the coiled material 100 is fed in a specific length in the conveyance direction in between the upper feed roll 24 and the lower feed roll 25 (an example of a pair of rolls). In step S50 (an example of a stoppage step), the feeding of the coiled material 100 is stopped after step S40 (an example of a feed step). In step S60 (an example of a meandering detection step), movement of the coiled material 100 from a specific conveyance position in the width direction perpendicular to the conveyance direction of the coiled material 100 during step S50 (an example of a stoppage step) is detected. Steps S80 to S120 (an example of pressure adjustments steps) involve adjusting the pressing force at which the upper feed roll 24 (an example of a roll) is pressed against the coiled material 100 being conveyed, on the basis of the detection in step S60 (an example of a meandering detection step), so that the meandering will be corrected. The coiled material 100 is conveyed by repeating step S40 (an example of a feed step), step S50 (an example of a stoppage step), step S60 (an example of a meandering detection step), and steps S80 to S120 (an example of pressure adjustment steps).

Thus, meandering of the coiled material 100 can be corrected by adjusting the pressing force on the coiled material 100 in steps S80 to S120 (an example of pressure adjustment steps) on the basis of the detection in step S60 (an example of a meandering detection step). Therefore, the operator does not have to constantly monitor the process, and does not have to go into the device, so it is a simple matter to correct meandering.

4. Other Embodiments

An embodiment of the present invention was described above, but the present invention is not limited to or by the above embodiment, and various modifications are possible without departing from the gist of the invention.

(A)

In the above embodiment, the value of $\Delta P_n$ was calculated by the operations in steps S90 to S120, but this is not the only option.

The a table of predetermined adjustment amounts from the initial value $P_0$ versus the over-threshold amount X calculated in step S90 may be stored in the feeder controller 20, and the change amount $\Delta P_n$ shown in step S120 may be set on the basis of this table.

Figure 12:
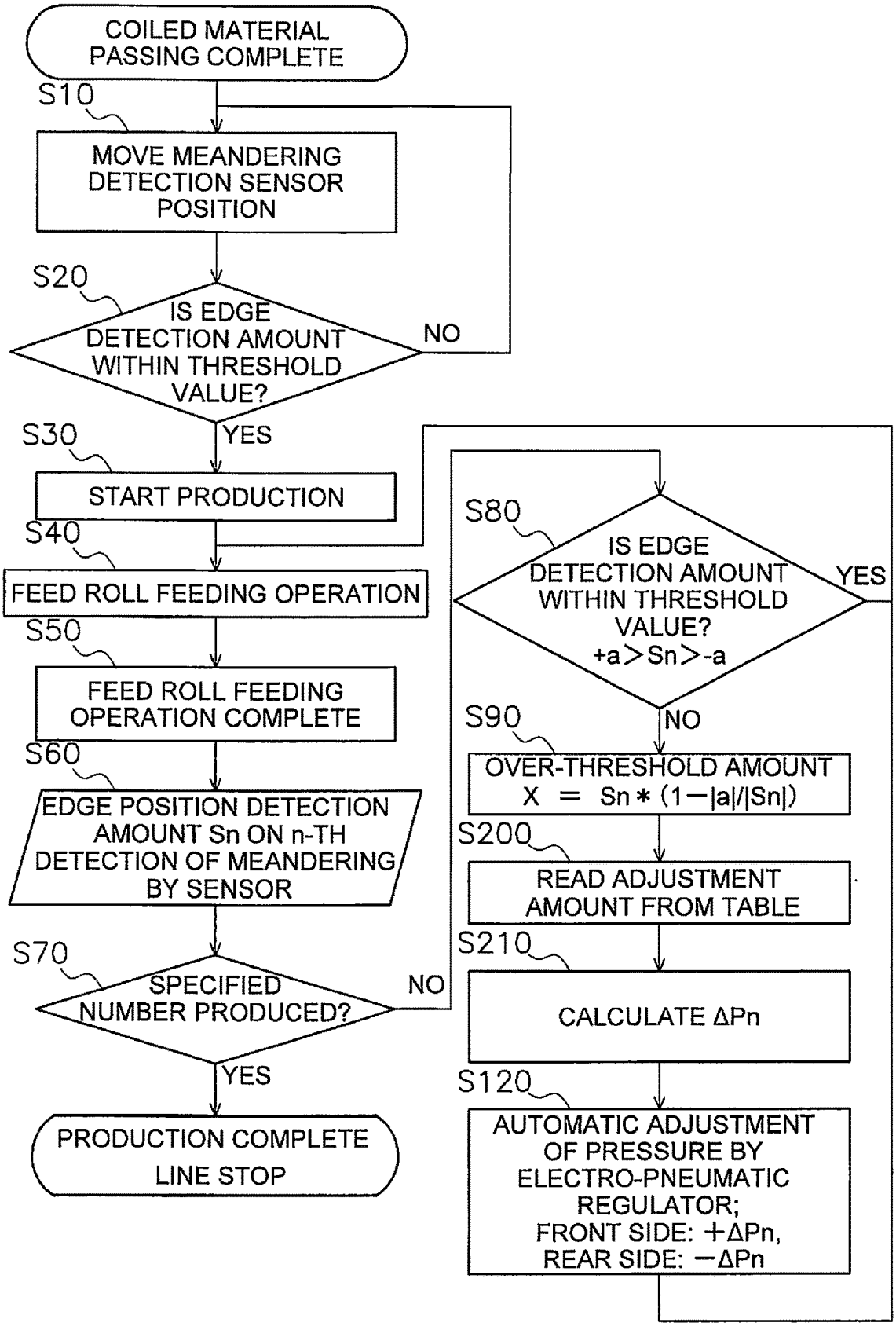
FIG. 12 is a flowchart of the operation of a leveler feeder in a modification example of the embodiment pertaining to the present invention.

A flowchart of this case is shown in FIG. 12. For example, let us assume that adjustment amounts of ±P (1 mm), ±P (2 mm), ±P (3 mm), and so forth from the initial values $P_0$ for when the offset is ±1 mm, ±2 mm, ±3 mm, and so forth are set. In this case, the pressure applied to the first end 24F and the second end 24R (the pressure determined by sensing the amount of meandering the n−1-th time) during feed of the coiled material 100 the n-th time is $P_0+P_{(1\ mm)}$ and $P_0-P_{(1\ mm)}$, and when it is detected in step S90 that the amount of meandering is +3 mm, in step S200 the adjustment amounts from the initial value of the pressure applied to the first end 24F the second end 24R during feed of the coiled material the n+1-th time are read out from the table. If we let the adjustment amounts that are read out be $P_{(3\ mm)}$ and $-P_{(3\ mm)}$, the pressure applied to the first end 24F and the second end 24R during feed of the coiled material 100 the n+1-th time is $P_0+P_{(3\ mm)}$ and $P_0-P_{(3\ mm)}$. Therefore, in step S210 the change amount $\Delta P_n$ is calculated as $P_{(3\ mm)}-P_{(1\ mm)}$. Also, the above-mentioned table may be provided for each material and thickness of the coiled material 100.

Furthermore, the change amount $\Delta P_n$ may be set according to the change amount $\Delta S_n$ calculated in step S100 in the above embodiment. That is, the adjustment amount from the initial value may be increased by a specific amount each time the meandering amount increases by 1 mm, and the adjustment amount from the initial value may be decreased by a specific amount each time the meandering amount decreases by 1 mm.

In short, the pressure applied to the first end 24F and the second end 24R may be adjusted so as to correct meandering.

(B)

In the above embodiment, the meandering detector 29 had the first laser sensor 91 and the second laser sensor 92, but laser sensors are not the only option.

Figure 13A:
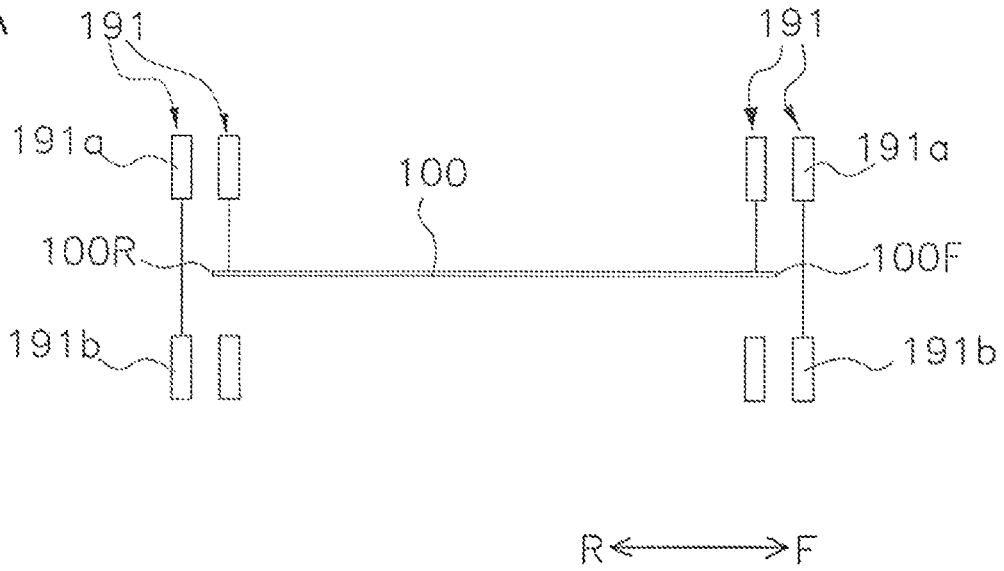
FIGS. 13A and 13B are diagrams illustrating the configuration of a meandering detector in a modification example of the embodiment pertaining to the present invention.

For example, as shown in FIG. 13*a*, a plurality of fiber sensors 191 may be provided instead of laser sensors. Each of the fiber sensors 191 has a projector 191*a* and a light receiver 191*b*. The fiber sensors 191 are disposed at both ends of the coiled material 100 along the width direction (the arrow FR direction).

Figure 13B:
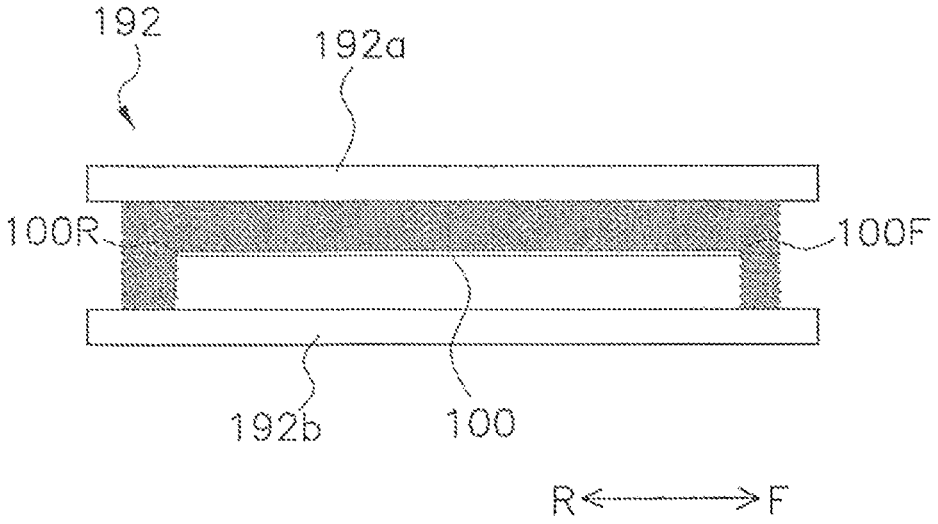

Also, as shown in FIG. 13*b*, a laser-based displacement sensor 192 capable of covering the entire maximum specified coil width may be used. The laser-based displacement sensor 192 has a light projector 192*a* and a light receiver 192*b*. The drive mechanism 93 need not be provided in this case.

(C)

The leveler feeder 2 was used as an example of a roll feeder in the above embodiment, but the feeder device may not have a leveler function for correcting winding curl in the coiled material 100, and may just feed the coiled material 100.

(D)

In the above embodiment, the system controller 5, the feeder controller 20, the uncoiler controller 34, and the passing controller 45 were described as being separate, but the system controller 5, the feeder controller 20, the uncoiler controller 34, and the passing controller 45 may all be combined in a single control device.

INDUSTRIAL APPLICABILITY

The roll feeder and the coiled material conveyance method of the present invention have the effect of allowing meandering to be easily corrected, and are useful in a coil line system or the like in which a coiled material is conveyed to a pressing machine or the like.

The invention claimed is:

1. A roll feeder adapted to intermittently feed a coiled material, the roll feeder comprising:

a paired first roll and second roll disposed so as to clamp the coiled material, the paired first roll and second roll being configured to feed the coiled material in a conveyance direction;

a meandering detector configured to detect meandering of the coiled material from a specific conveyance position in a width direction perpendicular to the conveyance direction of the coiled material;

a pressing component configured to press the first roll against the coiled material being conveyed; and a controller configured to control the roll feeder to intermittently feed the coiled material by repeatedly feeding and stopping the coiled material, to control the meandering detector to detect the meandering when the feeding of the coiled material is stomped, and to control the pressing component so as to correct the meandering based on a detection result by the meandering detector.

2. The roll feeder according to claim 1, wherein the pressing component includes a first pressure applicator linked to a first end side of the first roll, the first pressure applicator being configured to apply pressure to a first end so as to press the coiled material being conveyed, and a second pressure applicator linked to a second end side of the first roll, the second pressure applicator being configured to apply pressure to a second end so as to press the coiled material being conveyed, and the controller is further configured to correct the meandering by controlling the first pressure applicator and the second pressure applicator to adjust pressing force on the first end and the second end of the coiled material.

3. The roll feeder according to claim 2, wherein the meandering detector detects a meandering amount that the coiled material deviates from the specific conveyance position toward the first end side or the second end side, and the controller is further configured to control the pressing component so that when it is detected by the meandering detector that the coiled material moves by more than a specific threshold from the specific conveyance position toward the first end side, pressure applied to the first end is raised and pressure applied to the second end is lowered, and when it is detected by the meandering detector that the coiled material moves by more than the specific threshold from the conveyance position toward the second end side, pressure applied to the second end is raised, and pressure applied to the first end is lowered.

4. The roll feeder according to claim 3, wherein the controller is further configured to reduce pressure from a second pressure setting value predetermined for the second end by an adjustment amount that is the same as an adjustment amount by which pressure is increased from a first pressure setting value predetermined for the first end when the pressure applied to the first end is raised, and reduce pressure from the first pressure setting value by an adjustment amount that is the same as an adjustment amount by which pressure is increased from the second pressure setting value when the pressure applied to the second end is raised.

5. The roll feeder according to claim 4, wherein the controller is further configured to set the adjustment amount based on how much the meandering amount of the coiled material exceeds the specific threshold.

6. A roll feeder adapted to intermittently feed a coiled material, the roll feeder comprising:

a paired first roll and second roll disposed so as to clamp the coiled material, the paired first roll and second roll being configured to feed the coiled material in a conveyance direction;

a meandering detector configured to detect a meandering amount that the coiled material deviates from a specific conveyance position toward a first end side of the first roll or a second end side of the first roll in a width direction perpendicular to the conveyance direction of the coiled material;

a pressing component configured to press the first roll against the coiled material being conveyed, the pressing component including a first pressure applicator linked to the first end side of the first roll, the first pressure applicator being configured to apply a pressure to a first end so as to press the coiled material being conveyed, and a second pressure applicator linked to the second end side of the first roll, the second pressure applicator being configured to apply a pressure to a second end so as to press the coiled material being conveyed; and a controller configured to control the pressing component so as to correct the meandering based on the detection amount detected by the meandering detector, the controller correcting the meandering by controlling the first pressure applicator and the second pressure applicator to adjust a pressing force acting on the first end and a pressing force acting on the second end of the coiled material so that when it is detected by the meandering detector that the coiled material moves by more than a specific threshold from the specific conveyance position toward the first end side, the pressure applied to the first end is raised and the pressure applied to the second end is lowered such that an adjustment amount by which the pressure applied to the first end is increased from a first pressure setting value is the same as an adjustment amount by which the pressure applied to the second end is lowered from a second pressure setting value, and when it is detected by the meandering detector that the coiled material moves by more than the specific threshold from the conveyance position toward the second end side, the pressure applied to the second end is raised and the pressure applied to the first end is lowered such that such that an adjustment amount by which the pressure applied to the second end is increased from the second pressure setting value is the same as an adjustment amount by which the pressure applied to the first end is lowered from the first pressure setting value, the controller being further configured to set the adjustment amount during feed of the coiled material an n+1-th time based on an amount of change in the meandering amount during feed of the coiled material an n-th time from the meandering amount during feed of the coiled material an n−1 -th time, and n being a natural number of at least 1.

7. The roll feeder according to claim 6, wherein when the meandering amount during feed of the coiled material the n−1-th time is compared to the meandering amount during feed of the coiled material the n-th time, and it is determined that the meandering amount of the coiled material is increasing, the controller is further configured to increase the adjustment amount during feed of the coiled material the n+1-th time more than the adjustment amount during feed of the coiled material the n-th time.

8. The roll feeder according to claim 7, wherein the controller is further configured to increase the adjustment amount during feed of the coiled material the n+1-th time based on how much the meandering amount of the coiled material exceeds the specific threshold and the amount of change in the meandering amount the n-th time.

9. The roll feeder according to claim 7, wherein when the meandering amount during feed of the coiled material the n−1-th time is compared to the meandering amount during feed of the coiled material the n-th time, and it is determined that the meandering amount of the coiled material stops increasing or the meandering amount decreases, the controller is further configured to set the adjustment amount during feed of the coiled material the n+1-th time based on how much the meandering amount of the coiled material exceeds the specific threshold and the amount of change in the meandering amount the n-th time.

10. A roll feeder adapted to intermittently feed a coiled material, the roll feeder comprising:

a paired first roll and second roll disposed so as to clamp the coiled material, the paired first roll and second roll being configured to feed the coiled material in a conveyance direction;

a meandering detector configured to detect meandering of the coiled material from a specific conveyance position in a width direction perpendicular to the conveyance direction of the coiled material, the meandering detector including laser sensors disposed on both sides in the width direction;

a pressing component configured to press the first roll against the coiled material being conveyed; and a controller configured to control the pressing component so as to correct the meandering based on detection by the meandering detector.

11. A coiled material conveyance method adapted to intermittently feed a coiled material, the coiled material conveyance method comprising:

feeding the coiled material a specific length in a conveyance direction in between a pair of rolls;

stopping the feed of the coiled material after the feeding;

detecting meandering movement of the coiled material from a specific conveyance position in a width direction perpendicular to the conveyance direction of the coiled material during the stopping; and adjusting pressing force of a roll pressing on the coiled material being conveyed, so as to correct meandering based on detection of meandering during the detecting, the coiled material being conveyed by repeating the feeding, the stopping, the detecting, and the adjusting.

* * * * *